US007142200B2

(12) United States Patent
Yamagishi et al.

(10) Patent No.: US 7,142,200 B2
(45) Date of Patent: Nov. 28, 2006

(54) DISPLAY DEVICE AND DRIVING METHOD THEREOF

(75) Inventors: Yasuhiko Yamagishi, Mobara (JP); Tomohide Oohira, Mobara (JP)

(73) Assignees: Hitachi Displays, Ltd., Chiba-ken (JP); Hitachi Device Engineering Co., Ltd., Chiba-ken (JP)

( * ) Notice: Subject to any disclaimer, the term of this patent is extended or adjusted under 35 U.S.C. 154(b) by 214 days.

(21) Appl. No.: 10/442,232

(22) Filed: May 21, 2003

(65) Prior Publication Data

US 2004/0012580 A1 Jan. 22, 2004

(30) Foreign Application Priority Data

May 22, 2002 (JP) ..... 2002-147780

(51) Int. Cl.
*G09G 5/00* (2006.01)

(52) U.S. Cl. ..... 345/204; 345/98

(58) Field of Classification Search ..... 345/208, 345/210, 87, 90, 92, 98, 100, 204, 99, 205
See application file for complete search history.

(56) References Cited

U.S. PATENT DOCUMENTS 5,173,950 A * 12/1992 Sato et al. ..... 382/167
5,802,358 A * 9/1998 Konomi ..... 713/503
2002/0140662 A1* 10/2002 Igarashi ..... 345/98

FOREIGN PATENT DOCUMENTS

JP 2002-297108 3/2001

* cited by examiner

*Primary Examiner*—Richard Hjerpe
*Assistant Examiner*—Jean Edy Lesperance
(74) *Attorney, Agent, or Firm*—Reed Smith LLP; Stanley P. Fisher, Esq.; Juan Carlos A. Marquez, Esq.

(57) ABSTRACT

In a display device comprising a display panel driven in an active matrix scheme, a display control circuit generating image data and clock, and at least one source driver acquiring the image data in response to the clock and supplying image signals based on the image data to the display panel, the present invention generates dummy data in stead of the image data, makes the at least one source driver acquire the dummy data, reads out the dummy data acquired by the at least one source driver, compares the dummy data read out from the at least one source driver with the dummy data in an original state, and adjust delay time of the clock to the image signal in accordance with the comparison result, so as to reduce flicker in an image displayed by the display device due to timing difference between the image data and the clock.

8 Claims, 11 Drawing Sheets

DISPLAY DEVICE AND DRIVING METHOD THEREOF

BACKGROUND OF THE INVENTION

1. Field of the Invention

The present invention relates to a display device, particularly, a display device able to display a screen image of high quality by restraining the flicker of a display screen caused by a timing shift of display data and a-dot clock in data acquirement in a source driver, and a driving method of this display device.

2. Description of the Related Art

The display device of a so-called flat panel type is widely used as the display device of a high definition color monitor of a computer and other information devices, or a television receiver. There is typically a liquid crystal display device as the flat panel type display device of this kind. Further, in recent years, an organic EL display-device with an organic material as a light emitting element, a plasma display device, etc. are practically used in stages. Here, the schematic construction of the liquid crystal display device of an active mask type widely used at present will be explained as an example.

This liquid crystal display device has a so-called liquid crystal display panel in which a liquid crystal layer is nipped and supported between two (a pair of) substrates and at least one of the two substrates is basically constructed by transparent glass, etc. A voltage is selectively applied to various kinds of electrodes for pixel formation formed in the substrate of this liquid crystal display panel, and a predetermined pixel is turned on and off. The liquid crystal display device is excellent in contrast performance and high speed display performance. The general construction of the liquid crystal display device of this kind is already known. Accordingly, no literature of this liquid crystal display device is particularly described here.

SUMMARY OF THE INVENTION

FIG. 12 is a block diagram for explaining the summary of a driving system of the liquid crystal display device. In this figure, reference character 1 designates a display panel, and here shows a liquid crystal panel. Hereinafter, there is also a case in which the explanation is made with the display panel as the liquid crystal panel. This liquid crystal display device is constructed by the liquid crystal panel 1, a gate driver section 2, a source driver section 3, a display control circuit 4 and a power source circuit 5.

The gate driver section 2 and the source driver section 3 are arranged in a circumferential portion of the display panel 1. The gate driver section 2 is constructed by plural gate driver ICs arranged on one side of the liquid crystal display panel 1. The source driver section 3 is constructed by plural source driver ICs arranged on another side of the liquid crystal panel 1. The display control device 4 makes a timing adjustment suitable for the display of the liquid crystal panel as in alternating current formation of data, etc. with respect to a display signal inputted from a display signal source (HOST) such as a personal computer, a television receiving circuit, etc. The display control device 4 then converts the display signal to display data of a display format, and gives the converted display data to the gate driver section 2 and the source driver section 3 together with a synchronizing signal (clock signal). The gate driver section 2 and the source driver section 3 supply a gate signal to a gate line and also supply the display data to a source line on the basis of the control of the display control circuit 4 so that a screen image is displayed. The power source circuit 5 generates various kinds of voltages required in the liquid crystal display device.

FIG. 13 is an explanatory view of a schematic connecting construction of the source driver IC constituting the display control circuit and the source driver section in FIG. 12. FIG. 14 is a timing chart of the display data as an output signal of the display control circuit in FIG. 13 and a clock signal. Reference characters 31 to 3n in FIG. 14 designate source driver ICs constituting the source driver section. Only a source driver IC 31 located in a near end portion (A) of the display control circuit 4 and a source driver IC 3n located in a far end portion (B) are shown, and the source driver ICs arranged between these source driver ICs 31 and 3n are omitted in FIG. 14. Each of the source driver ICs 31 to 3n has the same circuit construction. In FIG. 13, the circuit construction of the source driver IC 3n located in the far end portion (B) is omitted. A timing adjustment circuit (normally called TCON) for adjusting the timing of the display data and the clock, a gray scale voltage generating circuit, etc. are arranged in the display control circuit 4.

"RGBDATA" as the output signal of the display control circuit 4 in FIGS. 13 and 14 shows digital display data of three colors (R, G, B), and "CLK" shows a clock signal synchronized with this "RGBDATA". Tc in FIG. 14 shows one data interval, and Ts shows a setup time of the clock "CLK" relating to the display data "RGBDATA", and Th shows a hold time of this clock "CLK", and n, n−1, n+1 show the respective display data. In FIG. 13, the display data "RGBDATA" and the clock "CLK" are transmitted to n-source driver ICs 31 to 31n, and the display data "RGBDATA" are generally transferred to the respective source driver ICs 31 to 31n at a TTL level and a MOS logic level in a parallel data format of an m-bit width.

The flow of the display data transferred to the liquid crystal panel 1 will next be explained. First, the display data "RGBDATA" from the display control circuit 4 are latched (held) at a rise edge of the clock "CLK" by a latch circuit 6 of the source driver ICs 31 to 31n as shown in FIG. 14. In the following explanation, the display data "RGBDATA" are set to be held at the rise edge of the clock "CLK". The latched display data "RGBDATA" are converted from the digital signal to an analog signal by an analog output circuit 7 of the source driver ICs 31 to 31n. The converted analog signal is applied to the liquid crystal panel 1 and a screen image is displayed.

FIG. 15 is an explanatory view of waveform distortion for comparing an ideal waveform of the display data outputted from the display control circuit and the actual waveform of the display data when n-source drivers are connected to the display control circuit. In FIG. 13, the waveform on the upper side shows the ideal waveform of the display data outputted from the display control circuit, and the waveform of a solid line among the waveform on the lower side shows an input waveform to the source driver IC 31 arranged in the near end portion (A), and the waveform of a dotted line shows an input waveform to the source driver IC 3n arranged in the far end portion (B). In the following description, when an explanation common to the source driver ICs connected to the near end portion (A), the far end portion (B) and an intermediate portion is made, they are simply denoted as the source driver IC.

With respect to the source driver IC 31 arranged in the near end portion (A) of the display control circuit 4 and the source driver IC 3n arranged in the far end portion (B), the distances between the display control circuit 4, the source driver IC 31 and the source driver IC 3n, i.e., the transmission path distance of the display data "RGBDATA" is short with respect to the source driver IC 31, and is long with respect to the source driver IC 3n. In particular, the distance between the source driver IC 31 and the source driver IC 3n tends to be lengthened more and more as the screen is large-sized in recent years. When this distance is lengthened, the waveform itself is distorted by the influences of reflection of the waveform due to mismatching of the impedance of the transmission path and the cross talk of a signal, etc. as shown by the lower side waveform of FIG. 15 while the display data are transmitted from the source driver IC 31 of the near end portion (A) to the source driver IC 3n of the far end portion (B).

The ideal data waveform outputted from the display control circuit 4 was approximately formed in a rectangular shape. However, when the source drivers are connected as a load, the actual data waveform inputted to each of these source drivers IC 31 to 3n becomes close to a sine wave. In FIG. 15, a period able to be theoretically recognized as "1" or "0" in conformity with the timing of the clock "CLK" by the source driver IC is set to Tpa in the source driver IC 31 arranged in the near end portion (A) and Tpb in the source driver IC 3n arranged in the far end portion (B). In this case, in the source driver IC 3n arranged in the far end portion (B), the distortion of the waveform is advanced more and more as shown by a dotted line of FIG. 15, and Tpa>Tpb is formed. This means that the margin of a period for reliably latching the display data is reduced in the source driver IC 3n arranged in the far end portion (B) in comparison with the source driver IC 31 arranged in the near end portion (A).

In addition to this reduction in the margin, the above display data able to be latched in the source driver IC 31 arranged in the near end portion (A) cannot be latched in the source driver IC 3n arranged in the far end portion (B) by the action of a phase shift of the display data "RGBDATA" and the clock "CLK" due to the dispersion of characteristics of a digital circuit of the display control circuit 4, the ambient temperature and a change in power voltage. Otherwise, conversely, the display data can be latched in the source driver IC 3n arranged in the far end portion (B), but cannot be latched in the source driver IC 31 arranged in the near end portion (A). As a result, flicker is caused on the display screen.

Such flicker is increased as the display screen size is large-sized and the display data are transmitted at high speed. This is because a so-called skew is caused between the display data and the clock and a shift is generated in acquirement (latching) timing of the display data so that the above flicker is caused. Such a phenomenon is also generated by an operating condition after the manufacture of a product such as the dispersion of parts, the ambient temperature, a threshold change at a logic level, etc., the individual liquid crystal display device, its using environment, etc. These contents are not limited to the liquid crystal display device, but are also similar in an organic EL display device, a plasma display device, and other display devices adopting driving methods similar to the above driving method. The measure of cut and try was conventionally taken by using a resistor and a capacitor. However, it was difficult to make a sufficient timing adjustment by such a measure, which was one of the problems to be solved.

An object of the present invention is to solve the above problem of the prior art, and provide a display device of high quality having no flicker by automatically adjusting the above timing shift at an operation starting time, and its driving method.

To achieve the above object, the present invention adopted the following means and method. Namely, a fixed pattern generating circuit for generating test data (dummy data) in a display control circuit, a test clock oscillator for generating a dot clock for a test at a speed lower than that of a dot clock for display at high speed, and a timing adjustment circuit for adjusting the time axis of the dot clock for display are arranged. The timing adjustment circuit has a comparator circuit for comparing the test data and data read from a source driver described later, and detecting the time axis difference (phase difference) between both the data, a delay circuit for delaying the above dot clock for display in timing for dissolving the time axis difference detected by the comparator circuit, etc.

In such a construction, the clock (dot clock) at high speed and the dummy data are first transmitted to a source driver section at a product forwarding time and a powering time in use, or any time, and are acquired and latched to each source driver IC constituting the source driver section by the above dot clock. Thereafter, one portion of the dummy data latched to the source driver IC is converted to serial data, and the display control circuit reads the serial data by the dot clock for a test at low speed. The display control circuit compares the dummy data transmitted at high speed and the serial data read at low speed. This comparison is performed by detecting the phase difference between both the data. The display control circuit varies the delay amount of the dot clock of the display data transmission on the basis of the above comparison result, and adjusts the timing of the dot clock for display to timing able to reliably latch the data by the source driver.

A timing shift (skew, i.e., the phase difference between signals) of the display data transmitted in the display data transmission path between the source driver section and the display control circuit is automatically corrected by the present invention constructed above. As this result, even when the display data of high speed are transmitted through a long transmission path to a certain extent, the flicker of a screen due to a latch error of the display data in the source driver section is improved. It is also possible to store the correction amount of the timing shift of the above display data, and automatically adjust the timing shift of the above display data by the stored correction amount without executing the above test mode at the powering time or any time. The typical construction of the present invention will next be described.

Display Device 1:

In a display device, comprising:

a display panel having a plurality of gate lines extended in a first direction and juxtaposed in a second direction transverse to the first direction, a plurality of source lines extended in the second direction and juxtaposed in the first direction, at least one gate driver outputting scanning signals to the plurality of gate lines, at least one source driver outputting image signals to the plurality of source lines, and a plurality of pixels each of which includes an active element selected by one of the plurality of gate lines and a pixel electrode driven in accordance with the image signal from one of the plurality of source lines in response to the active element selection; and a display control circuit generating and outputting a clock supplied to the gate driver and the source driver and data supplied to the source driver;

the present invention provides the source driver which acquires a group of the data outputted from the display control circuit and sends the group of the data acquired thereby to the display control circuit; and the display control circuit which adjusts a timing of the clock in accordance with a state of the group of the data sent from the source driver.

Display Device 2:

In the display device 1, the present invention makes the display control circuit compare another group of the data as generated therein and the group of the data sent from the source driver, and adjust the timing of the clock if the group of the data sent from the source driver is different from the another group of the data.

Display Device 3:

In the display device 1, the present invention makes the display control circuit adjust the timing of the clock with reference to a logic state of the group of the data sent from the source driver.

Display Device 4:

In the display device 1, the present invention makes the display control circuit generate the data as parallel form that consists of m bits of data signals (m: natural number greater than 1).

Display Device 5:

In the display device 4, the present invention makes the source driver convert the group of the digital data acquired therein to serial form and send the group of the digital data after converted to the serial form to the display control circuit, and makes the display control circuit convert the group of the data sent from the source driver to parallel form that consists of the m bits of data signals and compare the group of the data after converted to the parallel form with another group of the data as formed thereby.

Display Device 6:

In the display device 4, the present invention provides the source driver which has a latch circuit latching the group of the data supplied from the display control circuit in response to the clock and a parallel/serial converter circuit converting the group of the data latched by the latch circuit to serial form; and the display control circuit which has a serial/parallel converter circuit converting the group of the data which is converted to the serial form in the parallel/serial converter circuit to parallel form that consists of the m bits of data signals and timing adjustment means for adjusting the clock with reference to a result of comparison between the group of the data outputted from the serial/parallel converter circuit and another group of the data as generated thereby.

Display Device 7:

In the display device 1, the present invention provides the display control circuit which has a first circuit generating display data on the basis of inputted signals inputted thereto and a second circuit generating dummy data and outputs either the display data or the dummy data as the data; and the second circuit which fixes waveform variation of the dummy data with respect to each of the pixels arranged along one of the gate lines in the display panel, and generates the dummy data having the fixed waveform periodically.

Display Device 8:

In the display device 7, the present invention makes the display control circuit output one period of the dummy data having the fixed waveform for the group of the data.

Display Device 9:

In the display device 8, the present invention provides the source driver which acquires the one period of the dummy data and sends the one period of the dummy data acquired thereby to the display control circuit; and the display control circuit which compares the one period of the dummy data sent from the source driver with another period of the dummy data having the fixed waveform generated in the display control circuit, and adjusts the timing of the clock if the one period of the dummy data sent from the source driver is different from the another period of the dummy data.

Display Device 10:

In the display device 1, the present invention provides the display control circuit which has a first circuit generating a first clock on the basis of inputted signals inputted thereto and a second circuit generating a second clock having a different frequency from that of the first clock and outputs either the first clock or the second clock as the clock; and the source driver which acquires the group of the data in response to the first clock and sends the group of the data acquired thereby to the display control circuit in response to the second clock.

Display Device 11:

In the display device 10, the present invention provides the display control circuit generating the data as parallel form that consists of m bits of data signals (m: natural number greater than 1);

the source driver converting the group of the digital data acquired therein to serial form in response to the second clock and sending the group of the digital data converted in the serial form to the display control circuit; and the display control circuit converting the group of the data sent from the source driver to parallel form in response to the second clock and comparing the group of the data after converted to the parallel form with another group of the data as formed thereby.

Driving Method for Display Device 1:

In a driving method for a display device, having a display panel in which pixel lines each of which includes a plurality of pixels arranged in a first direction are juxtaposed in a second direction transverse to the first direction and at least one source driver supplying an image signal to each pixel belonging to one of the pixel lines being selected is arranged, and a display control circuit supplying parallel data and a clock supplied to the source driver, the present invention provides:

a first step for generating dummy data as the parallel data having waveform varying with respect to each of the plurality of pixels contained in one of the pixel lines and for making the source driver acquire the dummy data; and a second step for converting the dummy data acquired in the source driver to serial data, sending the serial data to the display control circuit, converting the serial data to reference data in a parallel form in the display control circuit, and comparing the reference data with the dummy data, wherein the delay time of the clock to the parallel data is adjusted to be extended in the second step if waveform variation of the reference data is different from that of the dummy data.

Driving Method for Display Device 2:

In the driving method for the display device 1, the present invention generates the dummy data to be compared with the reference data in the second step again.

Driving Method for Display Device 3:

In the driving method for the display device 1, the present invention acquires the dummy data by the source driver in response to the clock.

Driving Method for Display Device 4:

In the driving method for the display device 1, the present invention further provides:

a third step for generating the dummy data again and for making the source driver acquire the dummy data in response to the clock having the delay time adjusted in the second step; and a fourth step for converting the dummy data acquired in the source driver in the third step to serial data, sending the serial data to the display control circuit, converting the serial data to reference data in a parallel form in the display control circuit, and comparing the reference data with the dummy data generated in the fourth step.

Driving Method for Display Device 5:

In the driving method for the display device 4, the present invention adjusts the delay time of the clock (to the parallel data) to be extended in the fourth step if waveform variation of the reference data is different from that of the dummy data in the fourth step.

Driving Method for Display Device 6:

In the driving method for the display device 5, the present invention repeats the third step and the fourth step if the waveform variation of the reference data is different from that of the dummy data in the fourth step, wherein the dummy data acquisition performed by the source driver in the third step is based on the clock having the delay time adjusted in the another fourth step prior to the third step.

Driving Method for Display Device 7:

In the driving method for the display device 1, the present invention starts the first step by powering the display device.

Driving Method for Display Device 8:

In the driving method for the display device 1, the present invention generates the dummy data irrespective of image information inputted to the display device.

The present invention is not limited to the above construction and the constructions of embodiments described later, but can be variously modified without departing from the technical idea of the present invention. The other objects and constructions of the present invention will become apparent from the description of the embodiments described later.

BRIEF DESCRIPTION OF THE DRAWINGS

FIG. 7A is a waveform chart for typically explaining one example of the parallel data waveform converted from the serial data shown in FIG. 6 and compared with the original test display data and the delay time adjustment of the dot clock according to this parallel data waveform, and FIG. 7B is a waveform chart showing a shift in the waveform of the dot clock delayed every period Case B;

DETAILED DESCRIPTION

Figure 1:
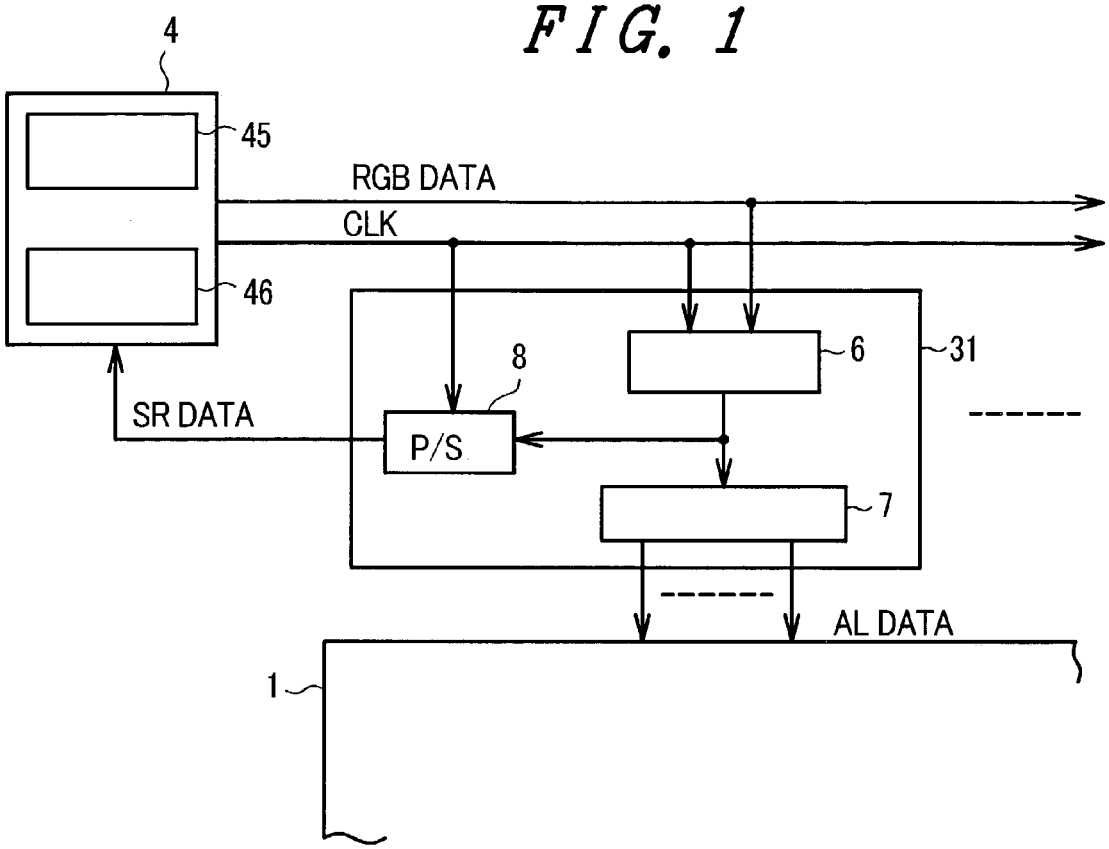
FIG. 1 is a block diagram for explaining the construction of a main portion of one embodiment of a display device in the present invention.

The embodiments of the present invention will next be explained in detail with reference to the drawings of the embodiments. FIG. 1 is a block diagram for explaining the construction of a main portion of one embodiment of a display device in the present invention. In this embodiment, the present invention is applied to a liquid crystal display device. In FIG. 1, reference character 1 designates a liquid crystal panel (it is also displayed as a TFT panel in FIG. 1), and reference character 31 designates a source driver IC. In a source driver section mounting n-source driver ICs (integrated circuits 31 - - - 3n) thereto along the circumference of the liquid crystal panel 1, one of the source drivers ICs is shown in FIG. 1, and the others are omitted.

Figure 12:
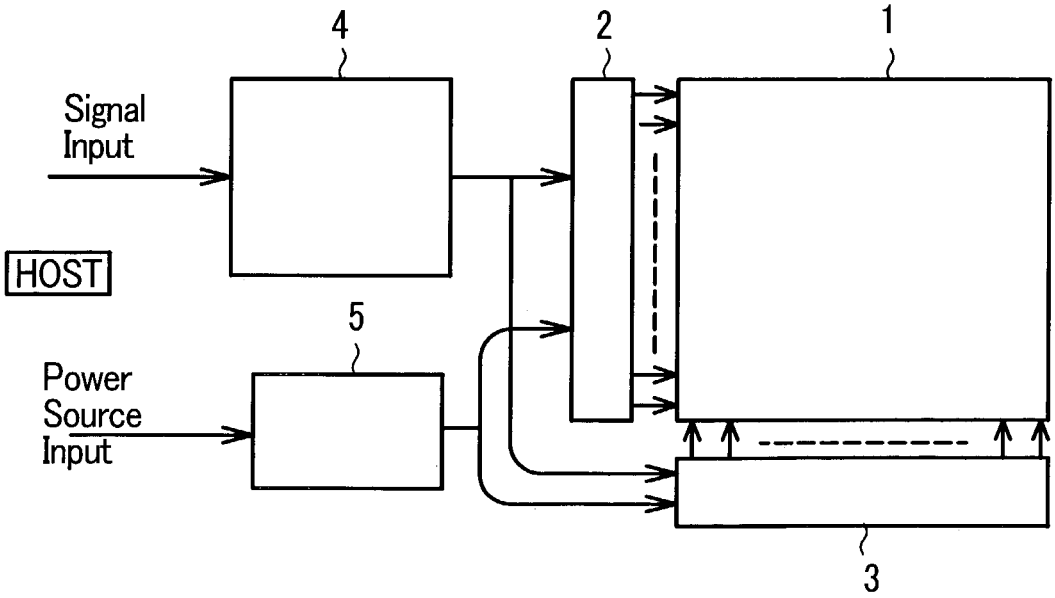
FIG. 12 is a block diagram for explaining the summary of a driving system of the liquid crystal display device.

FIG. 1 representatively shows only the source driver IC 31. Reference character 4 designates a display control circuit. The display control circuit 4 generates digital display data, a dot clock, a frame starting signal and other timing signals and performs data latch control in a gate driver section for supplying a scanning signal to a gate line explained in the above FIG. 12, and a source driver section for supplying the display data to a source line. In the following description, only the dot clock for latching (acquiring) the data display data to a data-latch circuit arranged in the source driver IC as the timing signal is shown.

Figure 13:
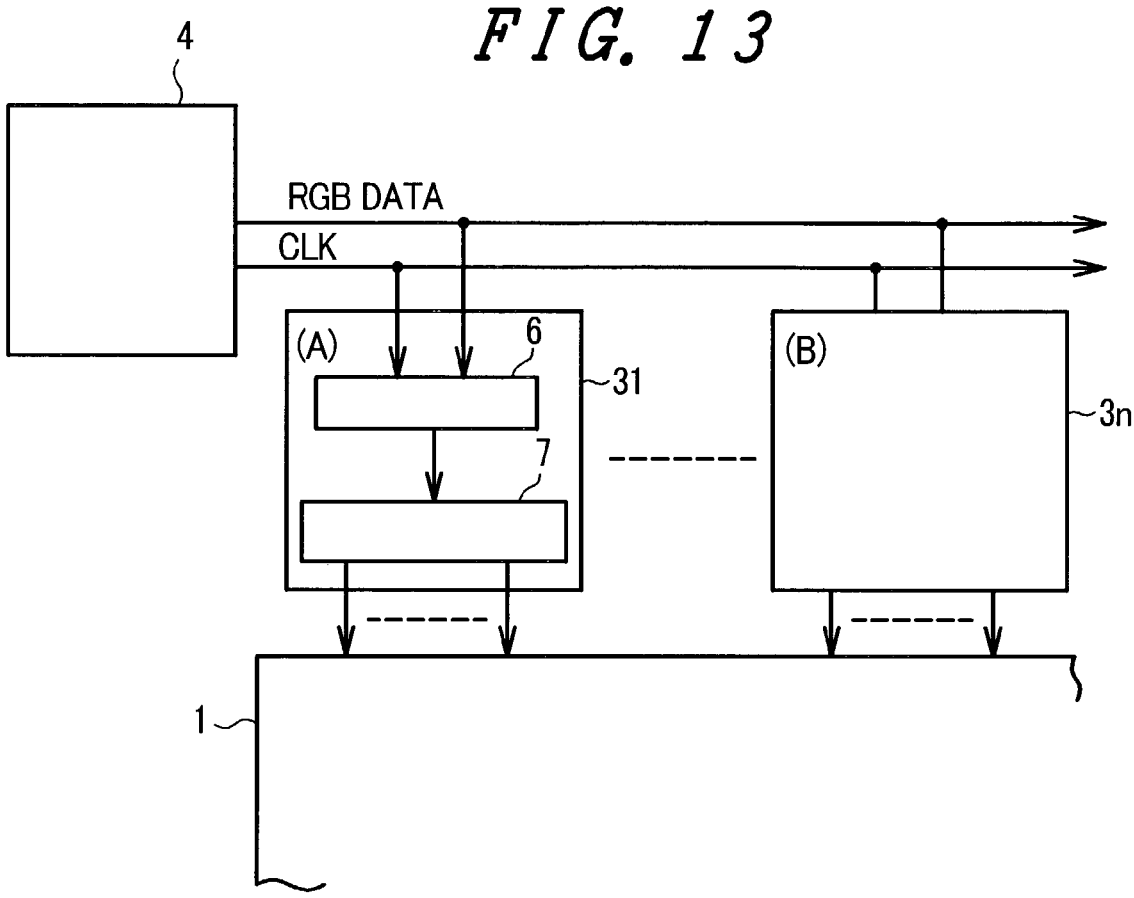
FIG. 13 is an explanatory view of the schematic connecting construction of the display control circuit and source driver ICs constituting a source driver section in FIG. 12.

The source driver IC 31 has the data-latch circuit (also denoted as a latch circuit in FIG. 1) 6, an analog output circuit 7 constructed by a digital/analog conversion circuit (also denoted as a D/A conversion circuit in FIG. 1) and a parallel/serial conversion circuit (also denoted as P/S in FIG. 1) 8. In FIG. 1, "RGBDATA" shows a transmission line of digital display data, etc. referred in the generation of image signals of red (R), green (G) and blue (B) using each source driver. "CLK" shows a dot clock for controlling the acquirement of the digital display data of the source driver. "SRDATA" shows serial data and "ALDATA" shows analog data. In contrast to the conventional display device described with reference to FIG. 13, data and a control signal not directly relating to image display as described later are also sent to the source driver IC through transmission lines of the digital display data and the dot clock in the display device in the present invention. Therefore, the reference characters RGBDATA and CLK are hereinafter defined as the transmission line of data or a signal.

While n-source drivers IC 31, - - - , 3n (n is a natural number) are assumed to be mounted to the circumference of the liquid crystal panel 1, each internal circuit thereof has a similar construction. Therefore, even in the liquid crystal panel 1 mounting plural source drivers (n≧2) thereto, its function is explained with the source driver IC 31 as a representative of the other source drivers. Accordingly, only the source driver IC 31 is shown in FIG. 1. This source driver (these source drivers) is connected to the display control circuit 4. The display control circuit 4 has a timing regulation circuit 45 and a timing adjustment circuit 46. The digital display data outputted from the display control circuit 4 are inputted to the n-source drivers through the transmission line RGBDATA, and the dot clock is inputted to the n-source drivers through the transmission line CLK. The digital display data are transmitted as parallel data of m-bits from the display control circuit 4 to the source driver (reference character 31 of FIG. 1). The latch circuit 6 is arranged within the source driver 31. Further, a shift register for storing the digital display data according to an image signal to be outputted to each of plural pixels arranged along the gate line (scanning signal line) of the liquid crystal panel 1 is arranged in the latch circuit 6. The digital display data (parallel data of m-bits where m is a natural number equal to or greater than 2) according to each of the plural pixels (dots) arranged along the gate line are sequentially acquired by the shift register in response to a pulse of the dot clock. Such a function of the latch circuit 6 is similar to that mounted to the conventional display device described with reference to FIG. 13.

Figure 15:
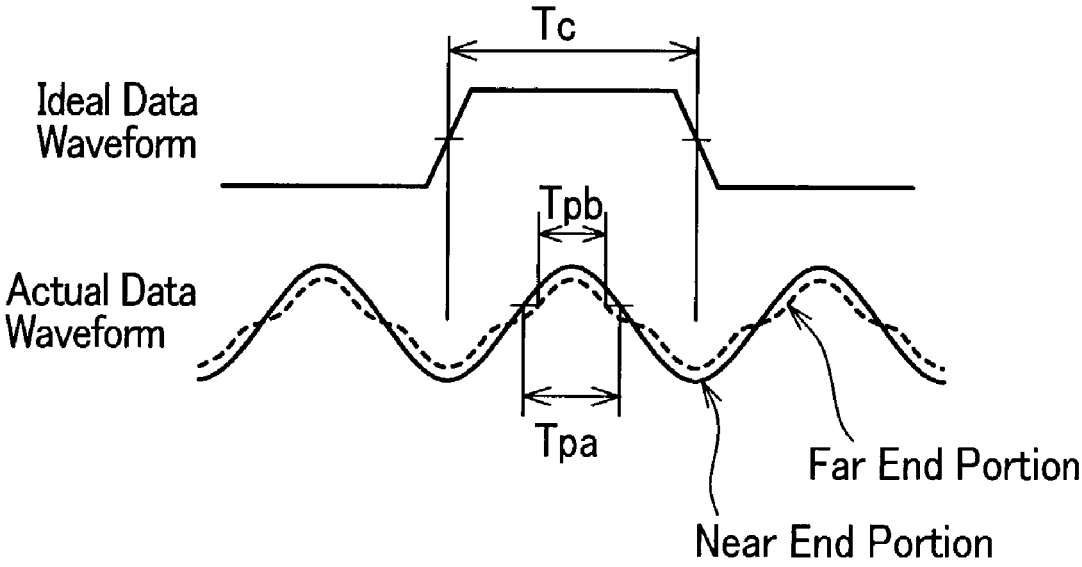
FIG. 15 is an explanatory view of waveform distortion for comparing an ideal waveform of the display data outputted from the display control circuit and the actual waveform of the display data when n-source drivers are connected to the display control circuit.

However, in the display device (liquid crystal display device in this embodiment) in the present invention, a parallel/serial conversion circuit 8 for receiving the output of the latch circuit 6 is arranged within the source driver 31. Thus, the parallel data of m-bits latched (acquired) to the latch circuit 6 are converted to serial data in synchronization with the clock outputted from the display control circuit 4 through the transmission line CLK, and these serial data are returned to the display control circuit 4. An acquirement error of the digital display data into the latch circuit 6 due to distortion of the waveform of the digital display data shown in FIG. 15 is held as the serial data.

Figure 2:
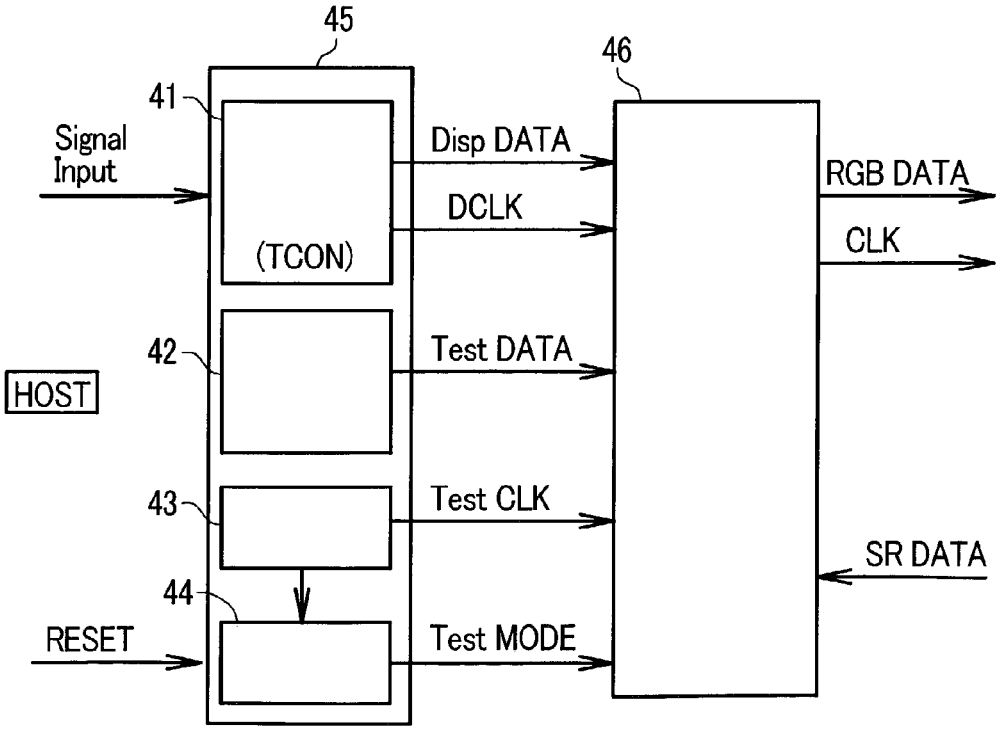
FIG. 2 is a circuit block diagram for explaining a constructional example of a display control circuit in FIG. 1.

FIG. 2 is a circuit block diagram for explaining one example of the construction of the display control circuit 4 in FIG. 1. The display control circuit has the timing regulation circuit 45 and the timing adjustment circuit 46. The timing regulation circuit 45 shown in this embodiment includes a fixed pattern generating circuit 42, an oscillator 43 and a counter 44 in addition to a drive timing generator circuit 41 for receiving image data inputted to the display device from its exterior (a computer and a television receiver) and its timing signal. The drive timing generator circuit 41 is also normally called a timing controller (TCON), and is also called a TFT drive timing generator circuit in a liquid crystal panel having a thin film transistor as an active element in each pixel.

Figure 8:
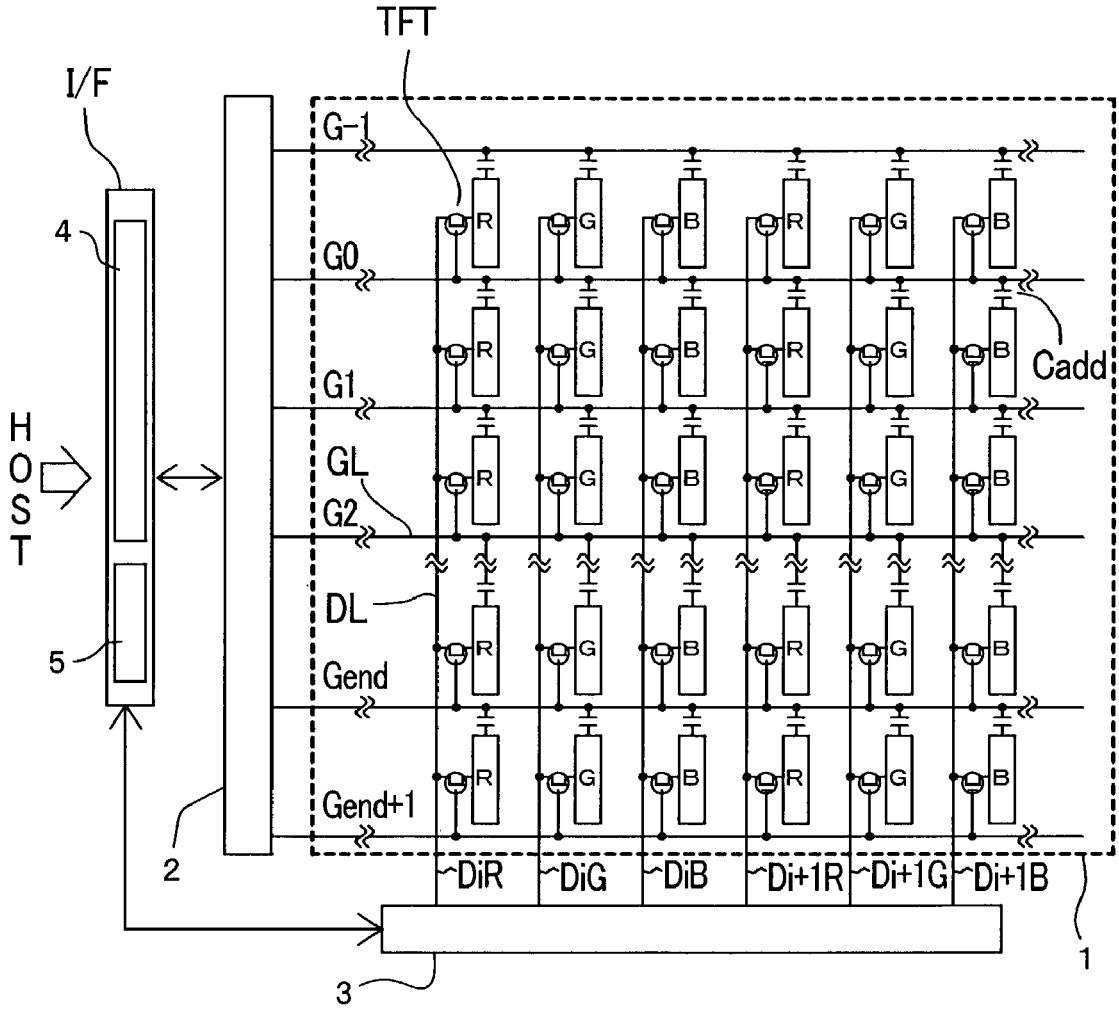
FIG. 8 is an explanatory view of an equivalent circuit of a liquid crystal display device of one embodiment of the present invention.

As shown in FIG. 8, this drive timing generator circuit 41 generates a frame starting signal for controlling the operations of the source driver IC and the gate driver IC for operating the active element arranged in the liquid crystal panel (display element), a horizontal synchronizing clock supplied to a scanning line, a dot clock DCLK, an alternating current forming signal and other timing control signals on the basis of an input signal such as the above image data (display data) inputted from an external signal source HOST of a personal computer, a television receiving circuit, etc., the above timing signal (synchronizing signal: Vsync, Hsync), etc. However, in this embodiment, since no signals except for the dot clock are here required in the explanation, these signals are omitted in the illustration.

The fixed pattern generating circuit 42 generates and outputs fixed pattern data (dummy data) constituting test display data "TestDATA". For example, these fixed pattern data are generated as digital display data constructed such that an image signal for displaying the entire screen in single gray scale is generated in the source driver IC. The oscillator 43 generates a test clock "TestCLK" having a constant frequency for reading the display data latched to the source driver IC as serial data. The frequency of this test clock TestCLK is lower than that of the dot clock "DCLK", and is set to 500 kHz with respect to the dot clock DCLK of e.g., 40 MHz. The counter 44 generates a starting signal "TestMODE" of a test mode on the basis of a reset signal (power-on reset signal) "RESET" generated in response to powering of the display device.

Figure 3:
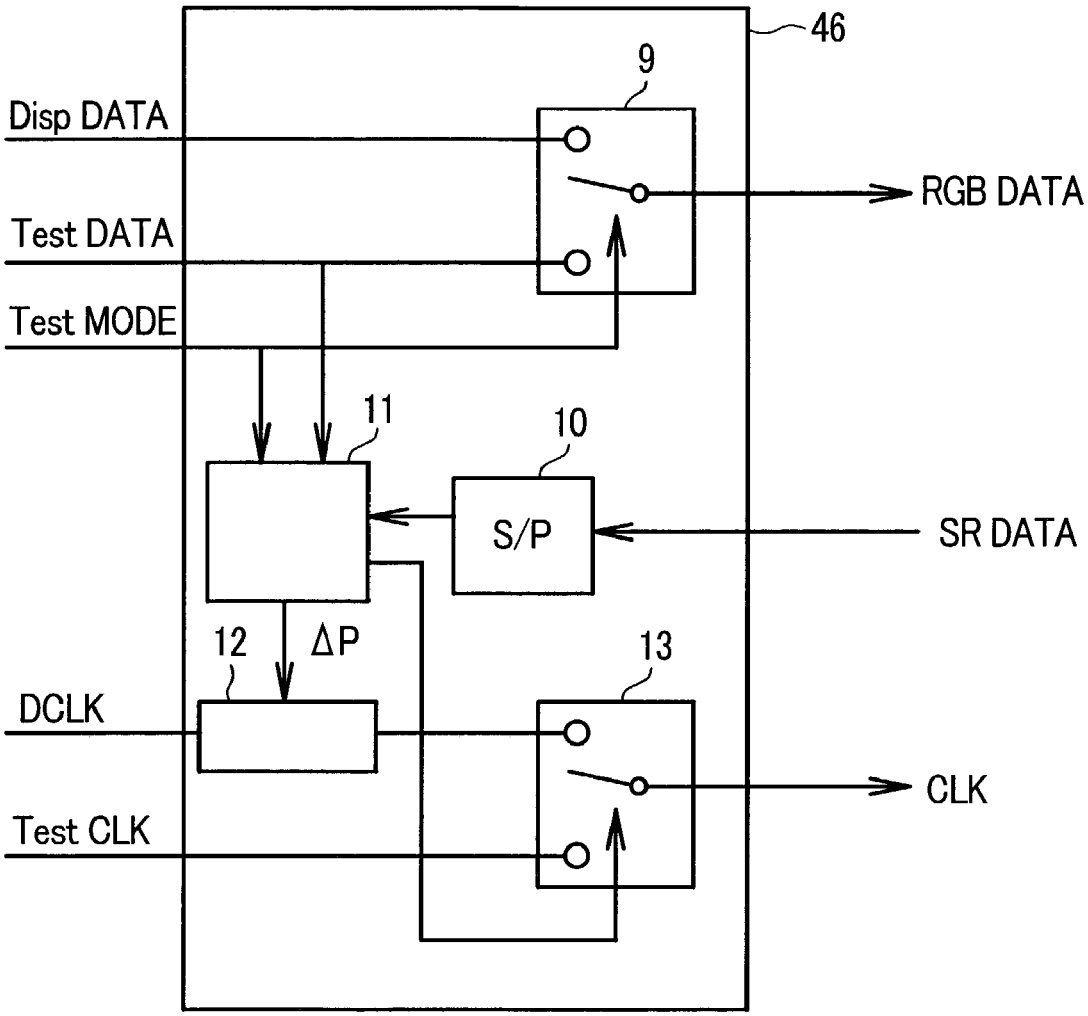
FIG. 3 is a circuit block diagram for explaining a constructional example of a timing adjustment circuit arranged in the display control circuit in FIG. 1.

FIG. 3 is a circuit block diagram for explaining one example of the construction of the timing adjustment circuit arranged in the display control circuit in FIG. 1. The timing adjustment circuit 46 is constructed by a data selector circuit 9, a serial/parallel conversion circuit (also denoted as S/P in FIG. 3) 10, a comparator circuit 11, a delay circuit 12 and a clock selector circuit 13. Reference character "DispDATA" designates digital display data, and "TestDATA" designates test display data. "TestMODE" designates a test mode signal. "DCLK" designates a high speed dot clock for display, and "TestCLK" designates a test clock at a frequency lower than that of the dot clock "DCLK".

The data selector circuit 9 switches the digital display data "DispDATA" of m-bits and the test display data "TestDATA". The digital display data DispDATA are generated as parallel data of m-bits by the drive timing generator circuit 41 on the basis of the image data inputted from the above external circuit to the display device. The test display data TestDATA are generated as parallel data of m-bits by the above fixed pattern generating circuit 42. In this embodiment, similar to the digital display data DispDATA, the test display data TestDATA are generated on the basis of the dot clock DCLK. Further, similar to the digital display data DispDATA, the test display data TestDATA are latched (acquired) to the source driver IC in response to the signal pulse of the dot clock DCLK. Accordingly, when the frequency of the dot clock DCLK is 40 MHz, the test display data TestDATA are inputted to the latch circuit (a shift register arranged in this latch circuit) of the source driver IC as dummy digital display data DispDATA changed in the period of an inverse number: 25 ns (nanosecond=$10^{-9}$ sec) of the dot clock DCLK frequency. However, the test display data TestDATA may be generated on the basis of another clock (e.g., the test clock TestCLK) having a frequency different from that of the dot clock DCLK, and may be also latched to the source driver IC in response to this clock.

The clock selector circuit 13 switches the dot clock "DCLK" of high speed for display, and the test clock "TestCLK" of a frequency lower than that of this dot clock "DCLK". The serial/parallel conversion circuit 10 converts the serial data from the parallel/serial conversion circuit 8 of FIG. 1 to parallel data, and gives the parallel data to the comparator circuit 11. The comparator circuit 11 makes a comparative arithmetic calculation of the output data of the serial/parallel conversion circuit 10 and the test display data "TestDATA". The test display data TestDATA generated as the parallel data in the fixed pattern generating circuit 42 are inputted to the latch circuit 6 of the source driver IC 31 through the timing adjustment circuit 46 (data selector circuit 9), and are once converted to serial data by the parallel/serial conversion circuit 8 arranged in the source driver IC 31. Thereafter, the serial data are again converted to parallel data by the serial/parallel conversion circuit 10, and are inputted to the comparator circuit 11. Accordingly, the comparator circuit 11 compares the test display data TestDATA of a state generated by the fixed pattern generating circuit 42, and the test display data TestDATA latched by the source driver IC 31 as the parallel data, and generates an output signal (comparison output) responsive to this difference. The delay circuit 12 determines the delay amount of the dot clock DCLK on the basis of the comparison output from the comparator circuit 11.

The data selector circuit 9 normally selects the digital display data "DispDATA" in a display mode (a period for displaying an image inputted to the display device), and outputs the digital display data "DispDATA" to the transmission line RGBDATA. In a test mode for inputting a test mode signal "TestMODE" generated by a reset signal at a powering time, the data selector circuit 9 selects the test display data "TestDATA" instead of the digital display data DispDATA, and outputs the test display data "TestDATA" to the transmission line RGBDATA. The operations of the display control circuit 4 and the source driver IC 31 of the display device shown in FIGS. 1 to 3 will next be explained with reference to the timing chart of FIG. 4.

Figure 4:
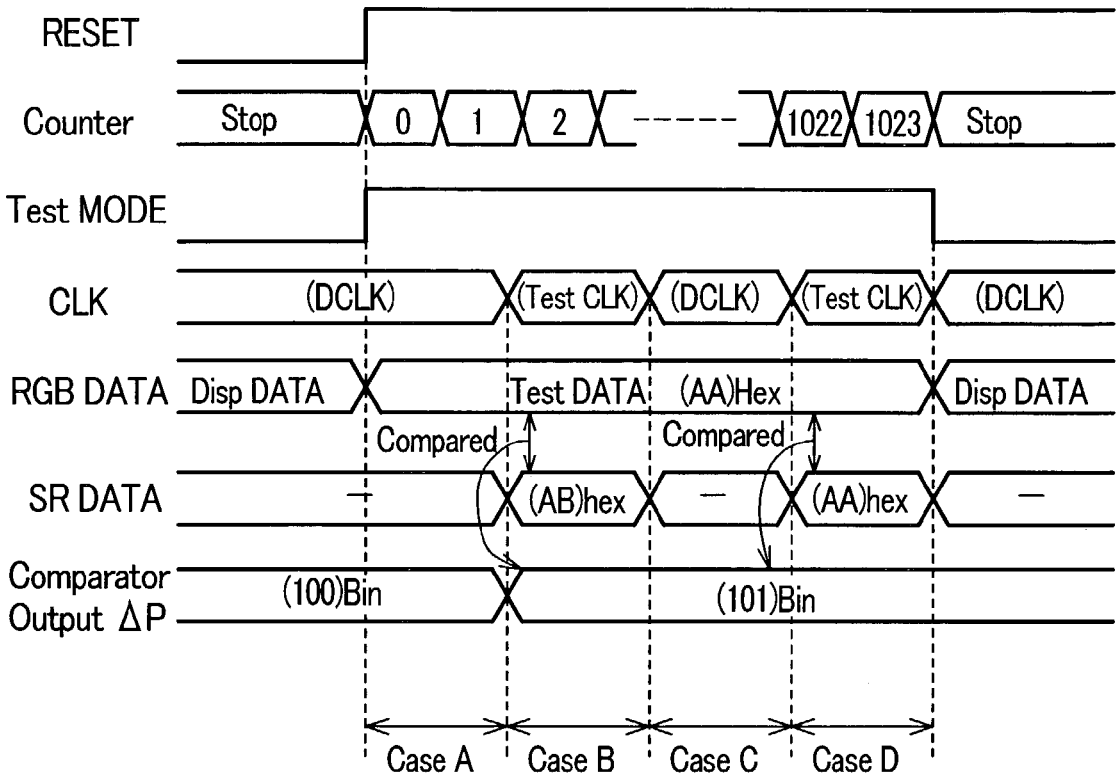
FIG. 4 is a timing chart for explaining the operation of one embodiment of the display device in the present invention.

FIG. 4 is the timing chart of respective data and signals inputted to the display control circuit 4 or generated within the display control circuit 4 or outputted from the display control circuit 4 with respect to the operation of the display device of this embodiment mentioned above. Reference characters given to respective waveforms correspond to signals, data or one of signals and data outputted to the transmission line shown by the same reference characters in FIGS. 1 to 3. When the display device (the liquid crystal display device in this embodiment) is powered, a reset signal "RESET" is inputted to the counter 44 arranged in the timing regulation circuit 45 included in the display control circuit 4. The counter 44 starts a predetermined count by this reset signal "RESET". When the reset signal "RESET" inputted to the counter 44 is changed from a low level to a high level, the above count is started on the basis of a predetermined clock. In this embodiment, the above test clock TestCLK generated by the oscillator 43 as the predetermined clock is inputted to the counter 44, and the count operation is performed. However, the clock for the count operation and its frequency are not limited to the test clock TestCLK and its frequency. The test mode signal "TestMODE" becomes a high level in response to the count operation start of the counter 44, and the test mode (period) is started. In this embodiment, the counter 44 is constructed by 10 bits, and the counter 44 stops the count operation when this count operation reaches a full count (1023rd count).

When the count operation of this counter 44 is performed by the test clock TestCLK of 500 kHz in frequency, a time required for one count is an inverse number: 2 μs (microsecond=$10^{-6}$ second) of the frequency of the test clock TestCLK. Accordingly, the above test mode is terminated when the test mode signal TestMODE is changed to the low level in response to the termination of the count operation of the counter 44 continued for 2×1024=2048 μs, i.e., about 2 ms (millisecond). Since the count operation of the counter 44 is stopped in a period noted as Stop in the counter output in FIG. 4, the test mode signal "TestMODE" is held at the low level.

In FIG. 4, while the test mode signal "TestMODE" is at the low level, the data selector circuit 9 of FIG. 3 selects the digital display data "DispDATA", and outputs these digital display data "DispDATA" to the transmission line RGBDATA, and sends these digital display data "DispDATA" to the source driver IC 31. In contrast to this, while the test mode signal "TestMODE" is at the high level, the data selector circuit 9 selects the test display data "TestDATA", and outputs these test display data "TestDATA" to the transmission line RGBDATA, and sends these test display data "TestDATA" to the source driver IC 31.

When the test mode signal "TestMODE" is at the low level, the clock selector circuit 13 always outputs the dot clock "DCLK" for display to the clock transmission line "CLK". In contrast to this, when the test mode signal "TestMODE" attains the high level, the clock selector circuit 13 outputs one of the dot clock "DCLK" for display and the test clock "TestCLK" to the clock transmission line "CLK" in response to an arithmetic calculation result of the comparator circuit 11 described later, etc. Namely, when the test mode signal "TestMODE" is at the low level, the display panel performs the normal display operation by the clock selector circuit 13. In contrast to this, when the test mode signal "TestMODE" is at the high level, the clock selector circuit 13 assists delay control for the adjustment of clock timing.

Here, one example of the display device and its driving method in the present invention will be more concretely explained by adding the following conditions to the above embodiment. The embodiment of the display device and its driving method in the present invention is not limited to each condition described below.

The data bit widths of the digital display data "DispDATA" and the test display data "TestDATA" outputted as parallel data to the transmission line RGBDATA are set to 8 bits. The serial data of the test display data TestDATA read (detected) by the parallel/serial conversion circuit 8 of the source driver IC 31, and sent to the serial/parallel conversion circuit 10 of the timing adjustment circuit 46 are similarly set to 8 bits. The period of the dot clock "DCLK" for display is set to 25 ns (40 MHz), and the period of the test clock "TestCLK" is set to 2 μs (500 kHz). An acquirement error (acquisition error, or latch error) of the serial data SRDATA due to the serial/parallel conversion circuit 10 is avoided by setting the frequency of the test clock TestCLK and the frequency of the dot clock to be different from each other. In this viewpoint, both the frequencies are not limited in height and its difference.

The comparator circuit 11 compares the test display data TestDATA of a state generated as parallel data in the fixed pattern generating circuit 42, and the test display data TestDATA once acquired by the source driver IC 31 and then detected as serial data and again converted to parallel data in the serial/parallel conversion circuit 10, and sends a digital data output ΔP of three bits responsive to its comparison result to the delay circuit 12. The delay circuit 12 controls delay (timing) of the above dot clock "DCLK" with reference to this digital data output ΔP. In the following exemplified display device, the parallel data (digital display data DispDATA) corresponding to each of pixels (dots) in one row (hereinafter, one line) arranged along a scanning signal line (gate line GL, see FIG. 8) within the display panel (liquid crystal panel 1) are sequentially acquired by the source driver IC 31 ( - - - 3n) by the dot clock DCLK rising (or falling) with a delay of 4 ns from an output starting time to these transmission lines RGBDATA. If the explanation is made by using FIG. 14, each of the parallel data of 8 bits outputted to the eight transmission lines RGBDATA in a period Tc (=25 ns) every pixel (dot) is acquired by the source driver in the rise of the dot clock (outputted to the transmission line CLK) delayed by a time Ts (=4 ns) in comparison with the rise (fall) time of each parallel data. The rise or fall of a signal waveform of the clock determining the data acquirement and the timing of data processing is also called an edge.

When the parallel data respectively responsive to all the pixels of the above one line are thus acquired by the source driver at the edge of the dot clock DCLK having the delay time of 4 ns, there is a case in which, in comparison with the parallel data responsive to the pixel located at one end (nearest the display control circuit 4) of one line, the waveform of the parallel data responsive to the pixel located at its other end (farthest from the display control circuit 4) is distorted, and its rise and fall are delayed in comparison with the edge of the dot clock DCLK. As this result, one portion of the parallel data responsive to the pixel located at the other end of one line is not acquired by the source driver so that the screen of the display device is flickered. In the display device and its driving method described in this embodiment, such an acquisition error of the parallel data is detected in advance at the starting time of the display device, and its result is once converted to serial data, and is again converted to parallel data by the serial/parallel conversion circuit 10. Thus, the difference between the parallel data outputted from the serial/parallel conversion circuit 10 and the normal parallel data outputted to the transmission line RGBDATA is clarified. The comparator circuit 11 changes the digital data output ΔP of three bits sent to the delay circuit 12 by one bit from this difference by recognizing the difference between these two parallel data. The delay circuit 12 delays the dot clock "DCLK" for display by 0.5 ns every time the digital data output ΔP is changed by one bit. For example, when the delay time of the edge of the dot clock DCLK with respect to the parallel data outputted to the transmission line RGBDATA is set to 4 ns as an initial condition of the operation of the display device, this delay time is extended to 4.5 ns by changing the digital data output ΔP by one bit.

In the display device of this embodiment, the timing adjustment circuit 46 (e.g., arranged in the display control circuit 4) shown in FIGS. 2 and 3 adjusts timings of the parallel data outputted to the transmission line RGBDATA, and the clock signal (e.g., dot clock) outputted to the clock transmission line CLK and controlling the parallel data acquisition by the source driver on the basis of the serial data sent from the parallel/serial conversion circuit 8 arranged in the source driver ( - - - 3n) (e.g., arranged in the source driver 31). The situation of this adjustment will be further explained with reference to FIGS. 4 and 5 to 7B.

Figure 5:
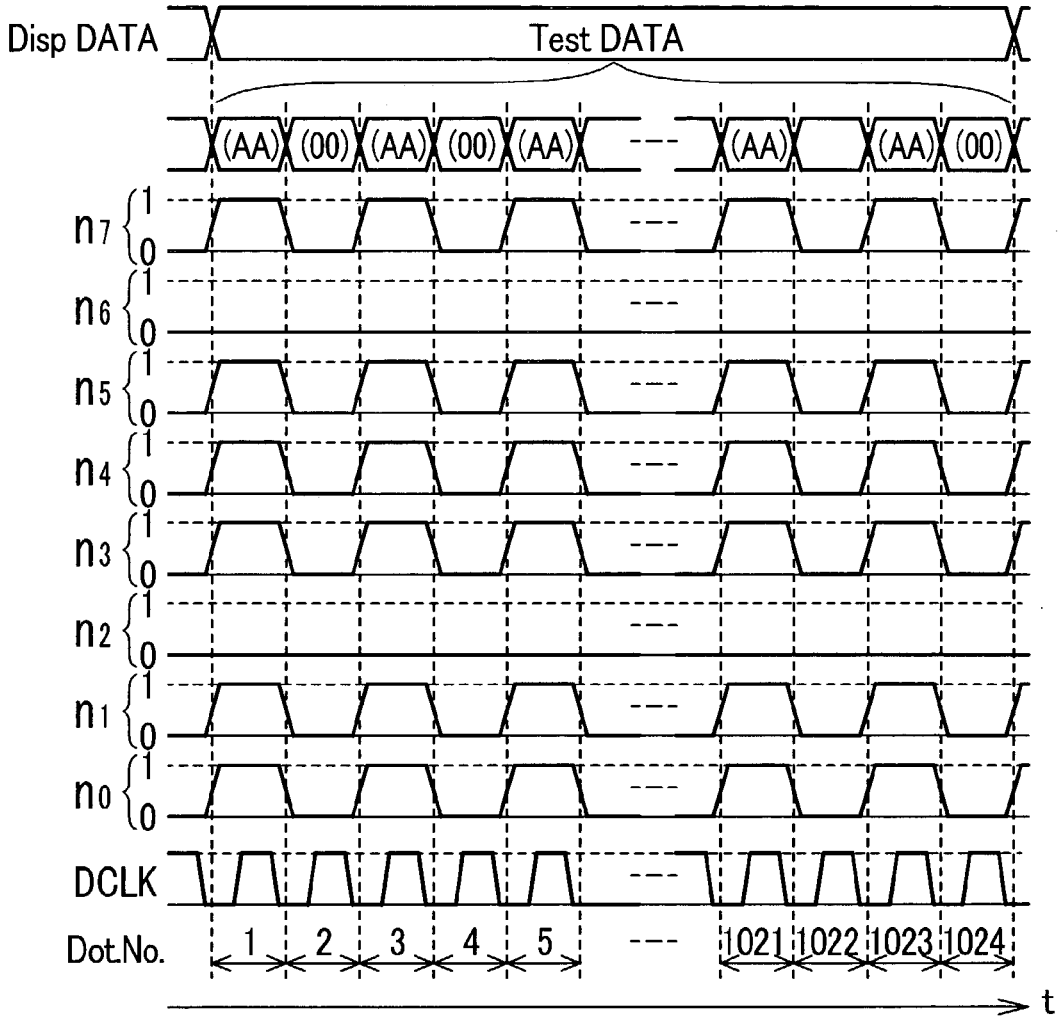
FIG. 5 is a waveform chart showing one example of the waveform of test display data outputted as parallel data of m-bits from the display control circuit in a period CaseA shown in FIG. 4, and the signal waveform of a dot clock for reading these test display data into a source driver.

In FIGS. 2 and 3, the transmission line RGBDATA for outputting the parallel data from the timing adjustment circuit 46 transmits a binary data signal by m-wirings responsive to its bit width: m (m is a natural number equal to or greater than 2). As mentioned above, in this embodiment, since the bit width of the parallel data is 8 bits, the transmission line RGBDATA has 8 wirings of $n_0$ to $n_7$. In contrast to this, the timing regulation circuit 45 shown in FIG. 2 generates the test display data as shown in FIG. 5 as the parallel data of 8 bits by the fixed pattern generating circuit 42 arranged in this timing regulation circuit 45. These test display data TestDATA have a value (pseudo information) responsive to each pixel included in the above one line of the display panel (liquid crystal panel). For example, when the display device has the display panel of an XGA standard of horizontal resolution 1024×vertical resolution 768, the test display data TestDATA include the value responsive to each of the 1024 pixels (dots).

In the test display data TestDATA, the pseudo datum responsive to every pixel is arranged in a predetermined period along the time axis in conformity with the characteristics of the source driver for sequentially acquiring the datum responsive to each pixel included in one line from the pixel located at one end thereof to the pixel located at the other end. This predetermined period is conformed to the period of a clock for successively acquiring these pseudo data included in the test display data TestDATA by the source driver. In this embodiment, similar to the digital display data DispDATA used in the actual image display, the test display data TestDATA are acquired by the source driver in response to the rise edge of the dot clock DCLK. Therefore, as shown in FIG. 5, the pseudo datum acquired by each of the first to 1024-th pixels sequentially appears at the interval (25 ns at a frequency of 40 MHz) of the dot clock DCLK.

In the test display data TestDATA illustrated in FIG. 5, a first pattern having a high level (1) in at least one of the eight wirings every one pixel, and a second pattern having a low level (0) in all the eight wirings are alternately repeated. When the binary data signal transmitted by each wiring: $n_x$(x is an integer equal to or greater than 0) included in the transmission line RGBDATA is set to show the pseudo datum of $2^x$ at the time of the high level (1) and the pseudo datum of 0 (zero) at the time of the low level (0), the first pattern of FIG. 5 for setting the data signal transmitted by wirings $n_0$, $n_1$, $n_3$, $n_4$, $n_5$ and $n_7$ to the high level (1) shows a pseudo datum of 187. Further, the second pattern of FIG. 5 shows a pseudo datum of 0 (zero). The pattern included in the test display data TestDATA is not limited to the first pattern and the second pattern illustrated in FIG. 5, but its pattern number may be increased. Further, it is not necessary to set one of these patterns to a pattern corresponding to the pseudo datum of 0 (zero). In the setting of any pattern, it is sufficient to change at least one of the plural wirings included in the transmission line RGBDATA from the low level to the high level, or from the high level to the low level every one or plural pixels. It is also sufficient to change the data signal transmitted in at least one of the plural wirings in at least two portions on one end side and the other end side of the plural pixels included in one line.

The pseudo datum of the parallel data shown by each of the first pattern and the second pattern of the test display data TestDATA illustrated in FIG. 5 is hereinafter noted as (AA) in the former case and (00) in the latter case in accordance with hexadecimal notation. Since the first pattern is shown as (AA), the first pattern is not limited to the pseudo datum: 187 set in one example mentioned above, but is defined as a universal pseudo datum able to be arbitrary changed in response to the bit width of the parallel data, the fixed pattern generating circuit 42, etc. The first pattern defined in this way shows the feature that at least one of plural data signals included in these parallel data shows a level different from that included in the parallel data of the second pattern. Further, in the test display data TestDATA (parallel data) of FIG. 5, the first pattern (AA) and the second pattern (00) alternately arranged along the time axis are included, and the pseudo datum of the first pattern (AA) is inputted to the shift register of the latch circuit 6 corresponding to an odd number (1, 3, 5, - - - , 1021, 1023) of the pixels of one line, and the pseudo datum of the second pattern (00) is inputted to the shift register of the latch circuit 6 corresponding to an even number (2, 4, - - - , 1022, 1024) of the pixels of this one line. These test display data TestDATA (parallel data) of FIG. 5 are hereinafter shown as (AA)Hex.

The timing regulation circuit 45 shown in FIG. 2 switches the test mode signal "TestMODE" sent from the counter 44 to the timing adjustment circuit 46 from this start from the low level to the high level in response to the start of the count operation of the counter 44 arranged in the timing regulation circuit 45. Thus, the data selector circuit 9 arranged in the timing adjustment circuit 46 selects the test display data TestDATA, and outputs these test display data TestDATA to the transmission line RGBDATA. This operation is performed in a period noted as "CaseA" in FIG. 4. In this period, the comparator circuit 11 selects the dot clock "DCLK" for display, and supplies the dot clock "DCLK" for display to the source driver IC 31 through the clock transmission line CLK. The test display data TestDATA outputted to the transmission line RGBDATA are acquired (latched) by the source driver IC 31 ( - - - 3n) in response to the rise edge of the signal waveform of the clock DCLK for display.

When the test display data TestDATA are the combination (AA)Hex of data signals transmitted by wirings $n_0$ to $n_7$ shown in FIG. 5, a data signal group included in the first pattern (AA) and a data signal group included in the second pattern (00) are alternately latched to the latch circuit 6 of the source driver IC 31 in FIG. 1. As explained with reference to FIG. 13, data and a signal (clock) outputted from the display control circuit 4 are sequentially propagated from the source driver IC 31 arranged near the display control circuit 4 in the plural source drivers IC 31 to 3n juxtaposed on one side of the display panel (liquid crystal panel 1) to the source driver IC 3n arranged far from this display control circuit 4 through the transmission line RGBDATA and the clock transmission line CLK.

As the test display data TestDATA are propagated by the data transmission line RGBDATA and the dot clock DCLK is propagated by the clock transmission line CLK from the source driver IC 31 (near end portion: A with respect to the display control circuit 4) nearest the display control circuit 4 to the source driver IC 3n (far end portion: B with respect to the display control circuit 4) farthest from the display control circuit 4, a timing error (or a phase shift) is caused between the waveform of the test display data TestDATA and the waveform of the dot clock DCLK. This also depends on the difference of characteristics as the transmission path of data or a signal of the data transmission line RGBDATA and the clock transmission line CLK. Accordingly, there is a case in which one of data signals to be included in the parallel data latched to the source driver IC 3n arranged in the far end portion (B) is not actually latched to the source driver IC 3n. Accordingly, there is also a case in which the parallel data outputted to the data transmission line RGBDATA as data (AA)Hex are acquired by the source driver IC 3n as parallel data different from (AA)Hex by the defect of one of the data signals included in the pseudo datum of only one pixel amount (AA) included in these outputted parallel data. The parallel data acquired by the source driver IC by the acquisition error of the parallel data due to the source driver IC in this way are noted as (AB)Hex with respect to the data (AA)Hex to be acquired. The acquirement of the incorrect parallel data as (AB)Hex due to the source driver IC causes a latch defect of the display device so that the screen of the display device is flickered.

Figure 14:
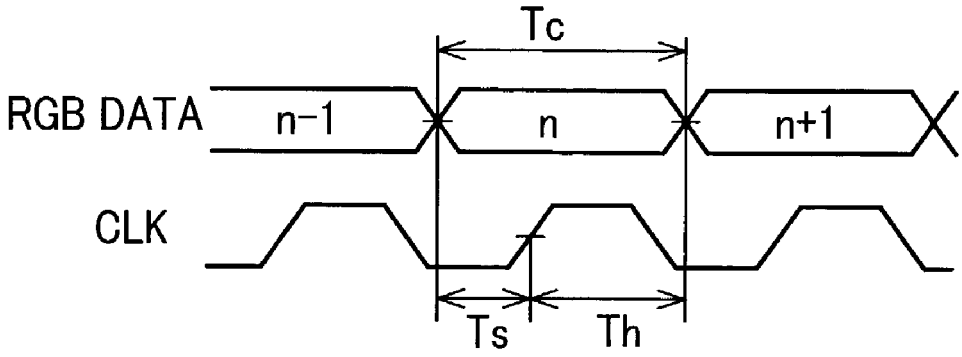
FIG. 14 is a timing chart of the display data as an output signal of the display control circuit in FIG. 13 and a clock signal.

A concrete example of the latch defect between the transmission paths for propagating a signal from the near end portion (A) to the far end portion (B) will be explained by using FIG. 14. With respect to the waveform shown by the parallel data (each data signal included in these parallel data) supplied to the source driver IC through the data transmission line RGBDATA at one data interval Tc (e.g., an n-th period) of these parallel data, the clock transmitted through the clock transmission line CLK rises to a high level after the passage of a setup time (Ts), and is held at the high level over a hold time (Th). In this embodiment, the setup time Ts of the clock shown in FIG. 14 is 4 ns. Further, the inter-terminal delay dispersion (typical value) between an output terminal of the data transmission line RGBDATA of m-bits and an output terminal of the clock transmission line CLK is set to TYP0.5 ns, and the delay dispersion (typical value) with respect to changes in temperature and voltage is set to TYP0.3 ns (Max×0.6 ns).

FIG. 15 shows the data signal (e.g., a data signal $n_x$ shown in FIG. 5) included in the parallel data passing through the data transmission line RGBDATA at the n-th data interval Tc (period) shown in FIG. 14. The data signal is originally transmitted while a rectangular "ideal data waveform" shown in FIG. 15 is shown every data interval Tc (here, a period of 25 ns) in the transmission path from the near end portion (A) to the far end portion (B). When the data signal belongs to the above digital display data DispDATA, the data waveform appearing every data interval Tc corresponds to one of the pixels included in one line, and an image signal inputted to this one pixel is generated in the source driver IC. However, in reality, the waveform of the data signal passing through the transmission path is gradually dulled by a load such as the source driver IC, etc. connected to this transmission path. For example, when plural (n in this embodiment) source driver ICs are connected to the transmission path in its intermediate portion reaching the far end portion (B), the waveform of the data signal transmitted by this connection is dulled (distorted) in a sine wave shape every data interval Tc. One example of the waveform of the data signal dulled in this way is shown as "the actual data waveform" in FIG. 15.

Since the waveform of the data transmitted by the data transmission line RGBDATA is dulled, a time able to recognize the logic state of these data as a high level or a low level in one data Tc becomes shorter than 25 ns (one period of the data interval Tc). Here, as explained in the above FIGS. 14 and 15, when the time able to logically recognize the logic state as "1" or "0" is set to Tpa in the source driver IC 31 arranged in the near end portion (A) and Tpb in the source driver IC 3n arranged in the far end portion (B), Tpa=12.5 ns (50% of 25 ns), and Tpb=10 ns (40% of 25 ns) are set.

Here, it is assumed that the logic at the data interval Tc of the above two data signals shown as "the actual data waveform" in FIG. 15 is recognized at the rise edge of a clock appearing at the center of this data interval Tc. In other words, the rise edge of this clock appears after 12.5 ns from the starting time of the data interval Tc of 25 ns in length. This clock corresponds to e.g., the dot clock DCLK transmitted by the clock transmission line CLK. However, the appearing time of this rise edge is different from the appearing time (after 4 ns from the starting time of the data interval Tc) already noted as this embodiment under the above assumption.

A period for setting each of the above two "actual data waveforms (data signals)" shown in FIG. 15 to the high level with respect to the appearing time of the rise edge of the clock at the center of the data interval Tc is determined by the above Tpa and Tpb. However, it is limited to a period located by Tpa/2 or Tpb/2 before from the appearing time of this rise edge that these "actual data waveforms (data signals)" are recognized as the high level in generation timing of the rise edge of the clock. When the logic state of the data signal is recognized in a position (near end portion (A)) near the display control circuit 4 at the rise edge of the clock, the data signal rises to the high level before 6.25 ns (=50% of 12.5 ns) with respect to the appearing time of the above rise edge. Therefore, a margin of 6.25 ns for steadily setting the data signal to the high level state is obtained. Further, when the logic state of the data signal is recognized in a position (far end portion (B)) separated from the display control circuit 4 at the rise edge of the clock, the data signal rises to the high level before 5.0 ns (=50% of 10.0 ns) with respect to the appearing time of the above rise edge. Therefore, a margin of 5.0 ns for steadily setting the data signal to the high level state is obtained.

The setup time Ts of the clock previously described with reference to FIG. 14 is defined as a time for delaying the appearing time of this rise edge (or fall edge) with respect to the rise or fall time of the data waveform when the level of the data waveform is recognized or acquired by the source driver, etc. at this rise edge (or fall edge). Thus, the level is recognized by the rise edge (or fall edge) of the clock, or is acquired by a peripheral circuit in a state in which the data waveform rising to the high level is steadily set to the high level state during the time Ts, or the data waveform falling to the low level is steadily set to the low level state during the time Ts. As the setup time Ts of the clock is lengthened, the data signal level is accurately recognized by this rise edge (or fall edge) by restraining the influences of waveform fluctuation of this data signal and noises superposed on this waveform fluctuation.

In the above display device of this embodiment, acquirement accuracy of the digital display data into the source driver is secured by the setup time Ts of the clock of 4 ns. With respect to the condition of the setup time Ts of the clock described in this embodiment, the change in the logic state of the data signal in the near end portion (A) described with reference to FIG. 15 gives the setup time Tsa of a sufficient length of 6.25 ns corresponding to the above margin to the rise edge of the clock. Further, the change in the logic state of the data signal in the far end portion (B) also gives the setup time Tsb of a sufficient length of 5.0 ns corresponding to the above margin to the rise edge of the clock. However, since "the actual waveform" shown in FIG. 15 is further delayed by another factor, the setup times Tsa, Tsb of the clock respectively defined are necessarily shortened.

The above another factor is the above inter-terminal delay, and the temperature and voltage change delay. If these delays simultaneously act on the data "RGBDATA", the above setup times respectively become Tsa=5.45 ns (=6.25 ns−0.8 ns), and Tsb=4.2 ns (=5.0 ns−0.8 ns). Further, after powering, the above setup times are respectively shortened by 0.3 ns when the temperature and voltage change delay in a lower second bit (e.g., a data signal $n_1$ shown in FIG. 5) of the parallel data transmitted by the data transmission line RGBDATA is changed from 0.3 ns to 0.6 ns at its maximum. Thus, Tsa=5.15 ns is formed in the source driver IC 31 arranged in the near end portion (A), and Tsb=3.9 ns is formed in the source driver IC 3n arranged in the far end portion (B).

As this result, no setup time Tsb of the above source driver IC 3n satisfies the above latch operation condition (4 ns) so that the source driver IC 3n causes a latch defect. Accordingly, as shown in the above one example, even when correct data (AA)Hex can be latched in the source driver IC 31 arranged in the near end portion (A), incorrect data (AB)Hex are always latched in the source driver IC 3n arranged in the far end portion (B).

After the period (CaseA of FIG. 4) for acquiring the test display data corresponding to each of the pixels included in one line of the display panel by the source driver is terminated, the clock selector circuit 13 selects the test clock TestCLK of a frequency lower than that of the dot clock DCLK instead of this dot clock DCLK in response to a command signal from the comparator circuit 11 of FIG. 3. The period of "CaseB" shown in FIG. 4 is started by an automatic switching operation of the clock outputted to this clock transmission line CLK.

The parallel/serial conversion circuit 8 shown in FIG. 1 converts the parallel data latched and held in the latch circuit 6 of the source driver IC to serial data in response to the above test clock TestCLK. For example, when the test display data TestDATA shown in FIG. 5 are latched without any acquirement error by the source driver ICs (all the plural source drivers), the parallel/serial conversion circuit 8 converts the latched parallel data (AA)Hex to serial data (AA) hex (the indexes Hex and hex reflect the difference between the parallel data and the serial data). However, when the source driver IC is unsuccessful in the latch even in one of the data signals to be included in the test display data TestDATA (parallel data (AA)Hex), the parallel/serial conversion circuit 8 converts the latched parallel data to serial data (AB)hex as (AB)Hex different from (AA)Hex. In each case, the serial data SRDATA outputted from the parallel/serial conversion circuit 8 are transmitted to the timing adjustment circuit 46 (see FIG. 3) of the display control circuit 4.

If there are parallel data held in the source driver IC even while (e.g., period: CaseA) the dot clock DCLK is inputted to the parallel/serial conversion circuit 8 through the clock transmission line CLK, the parallel/serial conversion circuit 8 converts these parallel data to serial data. However, in the display device of this embodiment for comparing the states of the test display data TestDATA after the test display data TestDATA are latched to the source driver IC, and the test display data TestDATA before the test display data TestDATA are latched to the source driver IC, the parallel data except for the test display data TestDATA latched to the source driver IC are useless. Accordingly, when the serial data SRDATA outputted from the parallel/serial conversion circuit 8 are data except for the serial data ((AA)hex and (AB)hex) generated on the basis of the test display data TestDATA, the serial/parallel conversion circuit 10 arranged in the timing adjustment circuit 46 considers these serial data SRDATA as invalid, and does not convert these serial data SRDATA to parallel data. In FIG. 4, the waveform of the serial data SRDATA noted as "-" shows the output of the parallel/serial conversion circuit 8 judged as invalid in this way.

Figure 6:
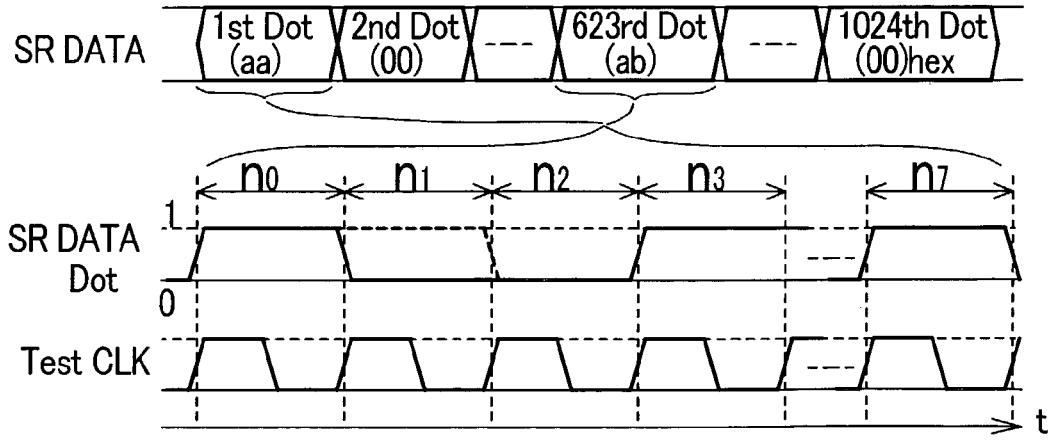
FIG. 6 is a waveform chart showing one example of the waveform of the test display data read from the source driver as serial data of m-bits in a period CaseB shown in FIG. 4.

The test display data TestDATA (see FIG. 5) of this embodiment for making the first pattern of the pseudo datum: (AA) correspond to an odd number of the 1024 pixels (dots) constituting one line of the display panel (image display area) of the XGA standard, and making the second pattern of the pseudo datum: (00) correspond to an even number of these pixels are converted to the serial data SRDATA as shown in FIG. 6. The parallel/serial conversion circuit 8 sequentially reads the parallel data of 8 bits acquired by the latch circuit 6 (shift register) from the data signal of a first bit to the data signal of an eighth bit every one pixel with respect to each of the 1024 pixels from a pixel (1st dot) at one end of one line to a pixel (1024th dot) at the other end. The waveform shown as SRDATA/Dot in FIG. 6 illustrates the serial data SRDATA read from each pixel belonging to the group of odd numbers of the above 1024 pixels. The parallel data (AA) of 8 bits corresponding to each of the pixels of the odd numbers are changed to serial data (aa) having a waveform in which the data signal transmitted by wirings ($n_0$ to $n_7$) arranged every one bit shown in FIG. 5 is arranged along the time axis. Accordingly, the above so-called first pattern: (aa) included in the serial data (AA)hex and corresponding to the pixels of the odd numbers has a waveform showing a level change of H (high), H, L (low), H, H, H, L, H every period of the test clock TestCLK in which eight data signals belonging to this first pattern are arranged from the lower bit (transmitted by wiring $n_0$) side.

In the period (the above CaseA) for sequentially acquiring the parallel data (AA)Hex (test display data) corresponding to the 1024 pixels constituting one line of the display panel by the source driver IC, it is supposed that no data signal $n_1$ of a lower second bit at the high level is latched when the parallel data (AA) of 8 bits corresponding to a 623rd pixel of these pixels are acquired by the source driver IC. The arrangement of the data signal levels of "H, H, L, H, H, H, L, H" constituting the first pattern: (aa) of the serial data (AA)hex corresponding to 310 odd pixels from a first pixel to a 621st pixel is changed to an arrangement of "H, L, L, H, H, H, L, H" in the 623rd pixel and odd pixels from this 623rd pixel far from the display control circuit 4. Thus, the serial data in which at least one of m-data signal levels included in the serial data: (aa) of m-bits is changed, are hereinafter noted as (ab).

A situation in which the first pattern: aa of the serial data corresponding to the pixel of an odd number is changed to serial data: (ab) different from these serial data after the 623rd pixel, is also shown in waveforms SRDATA, SRDATA/Dot of the serial data of FIG. 6. In the waveform SRDATA/Dot of FIG. 6, the parallel data corresponding to the 623rd pixel latched to the source driver IC are converted to serial data. Thus, in a period in which the data signal $n_1$ should be set to the high level, a result to be set to the low level is left in the serial data. In a period for transmitting the data signal $n_1$ of the waveform SRDATA/Dot of FIG. 6, the data signal level of the serial data: (ab) caused by a latch defect of the source driver IC is shown by a solid line, and the data signal level of the serial data: (aa) uninfluenced by this latch defect is shown by a dotted line.

Figure 7A:
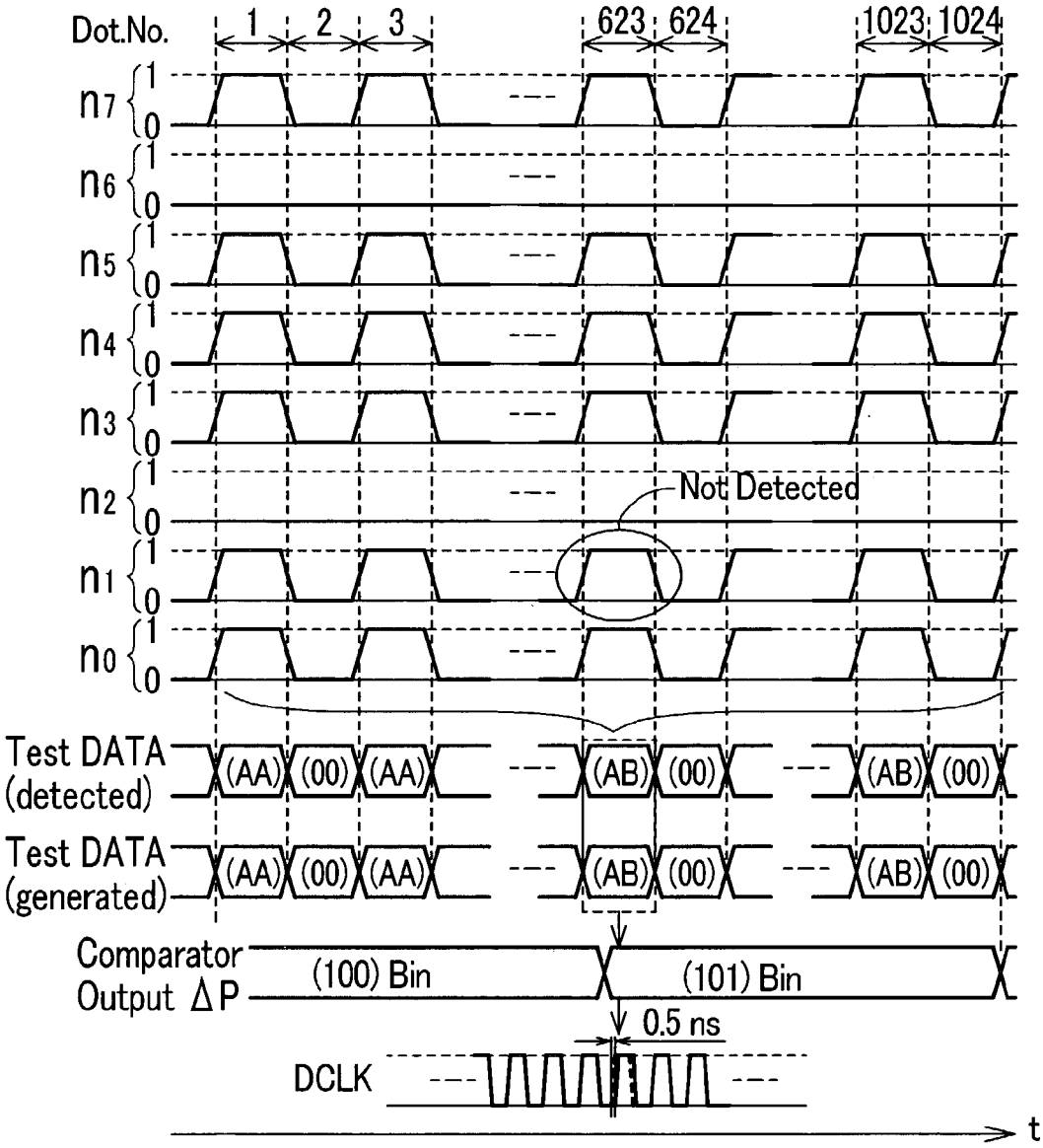
FIGS. 7A and 7B relate to a delay time adjustment of the dot clock in the period CaseB shown in FIG. 4.

When the serial data (AB) recording the latch defect of data corresponding to the 623rd pixel in this way are inputted to the serial/parallel conversion circuit 10 arranged in the timing adjustment circuit 46, the serial/parallel conversion circuit 10 generates parallel data (AB)hex reflecting the latch defect of these data. As shown in FIG. 7A, the serial/parallel conversion circuit 10 sequentially converts the serial data sent from the parallel/serial conversion circuit 8 every one pixel to parallel data, and sends the parallel data ((AA) and (00)) obtained every pixel to the comparator circuit 11. Accordingly, at a stage at which the serial/parallel conversion circuit 10 outputs the parallel data (00) corresponding to a 622nd pixel, the comparator circuit 11 recognizes that the test display data TestDATA latched to the source driver IC are the same as the test display data TestDATA of a state generated by the fixed pattern generating circuit 42. However, when the serial/parallel conversion circuit 10 sends the parallel data (AB) corresponding to the 623rd pixel to the comparator circuit 11, the comparator circuit 11 recognizes that the test display data TestDATA latched to the source driver IC are different from the test display data TestDATA of the state generated by the fixed pattern generating circuit 42. A situation in which the comparator circuit 11 recognizes these two parallel data, is also shown by two parallel data waveforms: TestDATA (detected) and TestDATA (generated) arranged in FIG. 7A.

Thus, the serial/parallel conversion circuit 10 arranged in the timing adjustment circuit 46 again converts the inputted serial data to parallel data of 8 bits and gives these parallel data to the comparator circuit 11. The comparator circuit 11 executes a comparative arithmetic calculation of the parallel data converted by the serial/parallel conversion circuit 10, and the parallel data of the test display data TestDATA of the state generated by the fixed pattern generating circuit 42. As mentioned above, when the value (AB)Hex of the parallel data converted by the serial/parallel conversion circuit 10 and the value (AA)Hex of the parallel data generated by the fixed pattern generating circuit 42 are not conformed to each other, the comparator circuit 11 outputs a digital data output (hereinafter also noted as an inconformity signal) ΔP to the delay circuit 12.

As already explained as the digital data output, the inconformity signal ΔP is generated on the basis of the comparing result of the parallel data at the generating time of the above test display data TestDATA in the comparator circuit 11, and the parallel data experientially latched by the source driver, and controls the operation of the delay circuit 12. The digital data output ΔP from the comparator circuit 11 are generated as 3-bit data constructed by e.g., a binary signal (binary number), and shows a value of (100)Bin e.g., when the display device is started (before the comparator circuit 11 detects the difference of the above two parallel data).

In contrast to this, the delay circuit 12 receives the dot clock DCLK generated by the timing generator circuit 41, and delays its output timing (the phase of a signal pulse) by a predetermined period. This delay period is determined by the digital data output ΔP sent from the comparator circuit 11 to the delay circuit 12. For example, when the value of ΔP is the above (100)Bin, the signal pulse of the dot clock DCLK is delayed in response to this value and is sent to the clock selector circuit 13. In contrast to this, when the comparator circuit 11 detects the difference of the above two parallel data, "1" is added to the digital data output ΔP sent from the comparator circuit 11 to the delay circuit 12 and data of (101)Bin are generated. The delay circuit 12 recognizes that the logic state of the digital data output ΔP received from the comparator circuit 11 is changed from (100)Bin to (101)Bin, and extends the delay period of the signal pulse of the dot clock DCLK by this change. In this embodiment, the delay circuit 12 extends the delay period of the dot clock DCLK by 0.5 ns every time the logic state of the digital data output ΔP is increased by one bit. Such connection of the operation of the comparator circuit 11 and the delay circuit 12 is also shown in each of the waveforms of the comparator circuit output ΔP and the dot clock DCLK of FIG. 7A. Further, with respect to the summary of the serial data SRDATA and the comparator circuit output data ΔP shown in FIG. 4, a time at which the serial data SRDATA are actually recognized as (AB)hex, and a time at which the logic state of the comparator circuit output data ΔP is increased by "1", are later than the starting time of the period CaseB in many cases.

Figure 7B:
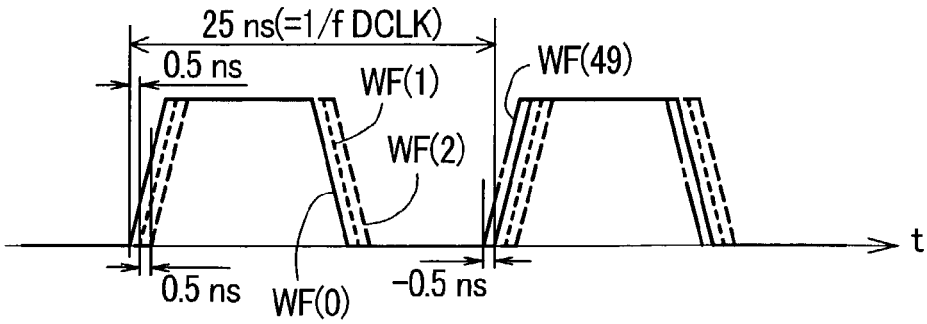

The delay circuit 12 may be set to be insensitive to the subtraction of the logic state of the digital data ΔP generated by the comparator circuit 11 (the delay period of the dot clock DCLK due to this is set to be unchanged), and the logic state of the digital data ΔP may be also returned to the initial value ((100)Bin in this embodiment) in response to a change in the test mode signal TestMODE from the high level to the low level, and a change in the reset signal RESET from the low level to the high level. FIG. 7B shows a situation in which the delay period of the dot clock DCLK is adjusted in this way. The waveform of the dot clock DCLK shown by a solid line shows a rise edge in a period of 25 ns. In contrast to this, as the logic state of the digital data ΔP is increased every "1", the waveform of the dot clock DCLK is shifted in response to the increasing amount (e.g., 0.5 ns) of the delay period in response to this increase in the logic state. In contrast to the waveform of the dot clock DCLK of the solid line WF(0), a dotted line WF(1) shows the waveform of the dot clock DCLK delayed by 0.5 ns, and a broken line WF(2) shows the waveform of the dot clock DCLK delayed by 1.0 ns. When the delay period due to the connection operation of the comparator circuit 11 and the delay circuit 12 is repeated 49 times, the waveform of the dot clock DCLK is delayed by 24.5 ns in comparison with that shown by the solid line as shown by a one-dotted chain line WF(49). In other words, in the waveform of the dot clock DCLK shown by the one-dotted chain line WF(49), the rise edge appears early by 0.5 ns in comparison with the waveform shown by the solid line WF(0).

As mentioned above, the delay circuit 12 delays the dot clock DCLK every 0.5 ns every time the digital data output (inconformity signal) ΔP received from the comparator circuit 11 is changed by one bit. Therefore, at a terminating time of the period CaseB shown in FIG. 4, the timing (delay of this rise edge with respect to the test display data period) of the dot clock DCLK is adjusted so as to also prevent the latch defect in the source driver farthest from the display control circuit 4. A timing signal selected by the clock selector circuit 13 and outputted to the clock transmission line CLK is switched from the test clock TestCLK to the dot clock DCLK under this premise. Thus, a period shown as "CaseC" in FIG. 4 is started. In the period CaseC, the test display data TestDATA outputted to the data transmission line RGBDATA are acquired by the latch circuit of the source driver in a condition in which the timing of the dot clock DCLK is adjusted (optimized) with respect to the acquirement of data from the data transmission line RGBDATA using the source driver.

As mentioned above, in the display panel (liquid crystal panel) of this embodiment in which the setup time Ts of the dot clock DCLK is adjusted such that each data signal of the parallel data transmitted by the data transmission line RGBDATA is acquired by the source driver at the rise edge delayed by 4 ns in comparison with the period of each data signal, the initial value (4 ns) of the setup time of the dot clock DCLK is invalidated by the waveform dullness and the delay of this data signal as the transmission distance of the above data signal from the display control circuit 4 is extended. In the display device of this embodiment, the setup time of a clock required to secure accuracy for acquiring image information transmitted by the data transmission line RGBDATA as parallel data by the source driver is set to be equal to or greater than 4 ns. However, as mentioned above, the setup time in the data acquirement using the source driver IC 3n (far end portion (B)) separated from the display control circuit 4 becomes Tsb=3.9 ns, and is less than 4 ns.

In contrast to this, the setup time in the source driver IC 3n arranged in the far end portion (B) becomes Tsb=4.4 ns by extending the delay time of the dot clock DCLK by 0.5 ns in the period CaseB. Accordingly, a sufficient margin in the level change of the parallel data to be acquired with respect to the rise edge of the dot clock DCLK is secured. The setup time of the dot clock DCLK in the data acquirement using the source driver IC 31 (near end portion (A)) near the display control circuit 4 is also extended from Tsa=5.15 ns to Tsa=5.65 ns. As this result, in each of the source driver IC 31 arranged in the near end portion (A) and the source driver IC 3n arranged in the far end portion (B), data (image information) are acquired in a state in which these data are sufficiently steadily set to the high level or the low level. Therefore, an acquisition error of the data due to the source driver is reduced and flicker caused on the screen of the display device is also restrained.

Similar to the period CaseB, the test display data TestDATA acquired by the source driver in the period CaseC shown in FIG. 4 are read as serial data SRDATA in a period CaseD subsequent to the period CaseC, and are again converted to parallel data in the timing adjustment circuit 46 arranged in the display control circuit 4. Thereafter, these parallel data are inputted to the comparator circuit 11, and are compared with the test display data TestDATA of the state generated by the fixed pattern generating circuit 42. Thus, it is verified that the latch circuits 6 respectively arranged in the source driver IC 31 arranged in the near end portion (A) and the source driver IC 3n arranged in the far end portion (B) similarly latch the parallel data (AA)Hex transmitted by the data transmission line RGBDATA.

With respect to the period CaseD, the dot clock DCLK selected by the clock selector circuit 13 by a command signal from the comparator circuit 11 is switched to the test clock TestCLK and is outputted to the clock transmission line CLK and the period Case D is started. The parallel/serial conversion circuit 8 reads the test display data TestDATA held in the source driver IC as serial data SRDATA in response to the test clock TestCLK outputted to the clock transmission line CLK, and sends these test display data TestDATA to the serial/parallel conversion circuit 10 arranged in the timing adjustment circuit 46. The serial data SRDATA are converted to parallel data by the serial/parallel conversion circuit 10, and are compared with the test display data TestDATA of the state generated by the fixed pattern generating circuit 42 in the comparator circuit 11. If the delay period of the dot clock DCLK is suitably adjusted in the period CaseB, the serial data SRDATA are read from the source driver IC as (AA)hex. Therefore, the serial data SRDATA are converted to the same parallel data (AA)Hex as the test display data TestDATA generated in the fixed pattern generating circuit 42 by the serial/parallel conversion circuit 10. At this time, the digital data of three bits outputted from the comparator circuit 11 to the delay circuit 12 maintain the logic state (101)Bin set in the period CaseB, and no delay circuit 12 changes the delay time of the dot clock DCLK.

In the above test mode operation of the display device from the period CaseA to the period CaseD, the period CaseA is applied to a process for acquiring the test display data by the source driver. The period CaseB is applied to a process for confirming the latch operation of the source driver by using the test display data acquired by the source driver, and adjusting the delay period of the dot clock DCLK with respect to the detection of a latch defect of the source driver. The period CaseC is applied to a process for again acquiring the test display data by the source driver by the dot clock DCLK adjusted in the period CaseB with respect to its delay period. The period CaseD is applied to a process for confirming that no latch defect is caused in the source driver by using the test display data acquired by the source driver (that the delay period of the dot clock DCLK is suitably adjusted in the period CaseB). Therefore, when no latch defect of the source driver is detected in the period CaseB, no subsequent processes of the periods CaseC and CaseD are required.

In contrast to this, when the latch defect of the source driver is again detected in the period CaseD, the delay period of the dot clock DCLK is again adjusted in the period CaseD, and the processes of the periods CaseC and CaseD are then sequentially performed. Namely, when no comparative arithmetic results of two parallel data using the comparator circuit 11 are conformed to each other in the process of the period CaseD, the operation corresponding to the process of the above period CaseB and the operation corresponding to the process of the period CaseC are repeated until the comparator circuit 11 confirms the conformity of these two parallel data. At this time, as shown in FIG. 7B, the waveform of the dot clock DCLK is gradually delayed every predetermined time (e.g., 0.5 ns) in response to the repetition of the processes of the periods CaseB and CaseC. Thus, the delay time of the clock transmitted by the clock transmission line is adapted to the waveform of data transmitted by the data transmission line RGBDATA.

FIG. 4 shows the periods CaseA, CaseB, CaseC and CaseD at an equal length, but the length is actually different every period. The lengths of periods CaseB and CaseD are longer than those of periods CaseA and CaseC in many cases.

When the optimization of the delay time is terminated by the above series of operations from the period CaseA to the period CaseD and the counter 44 reaches a full count, the test mode signal TestMODE is changed from the high level to the low level, and the digital display data DispDATA including image information are outputted to the data transmission line RGBDATA, and the dot clock DCLK is outputted to the clock transmission line CLK. The display device starts an image display operation based on the image information. A period required until the counter 44 reaches the full count, can be suitably selectively determined in response to the device kind and the specification of the display device.

In the display device of this embodiment, the parallel data held in the latch circuit of the source driver IC are converted to serial data and are read so that a terminal number of signal lines required in this conversion, etc. is reduced and its circuit construction is simplified. Therefore, manufacture cost of the entire display device is restrained. However, in view of the gist of the present invention, it is not necessary to convert the parallel data held in the source driver to the serial data. Accordingly, effects intended by the display device and its driving method in the present invention are obtained similarly to those of the above embodiments even when the parallel data held in the latch circuit of the source driver IC are transferred to the comparator circuit of the timing adjustment circuit 46 as they are.

The delay time of the dot clock adjusted by the delay circuit 12 in the test mode reaching the above periods CaseA to Case D may be held in the delay circuit 12 as a timing adjustment value, and the timing of the data output to the data transmission line RGBDATA at a re-powering time of the display device once turned off, and the clock output to the clock transmission line CLK may be adjusted by using this timing adjustment value. In this case, a hold circuit is arranged in the delay circuit 12. Further, in the above embodiment, the test mode signal TestMODE for starting the test mode is generated on the basis of the reset signal RESET generated at the powering time to the display device. However, instead of this, the test mode signal TestMODE may be also generated on the basis of the turning-on of another switch.

FIG. 8 is an explanatory view showing an equivalent circuit of one embodiment of the display device in the present invention. This equivalent circuit can be adopted in various kinds of display devices (a liquid crystal display device, an electro-luminescence display device, a field emission type display device, etc.) operated by an active matrix system. A pixel electrode and an active element (switching element) for supplying a voltage or an electric current responsive to an image signal to this pixel electrode are arranged in each pixel of the display panel arranged in these display devices. In FIG. 8, the active element corresponds to a thin film transistor TFT.

The plural pixels constructed in this way are two-dimensionally arranged along a first direction (e.g., the vertical direction) and a second direction (e.g., the horizontal direction) transverse to this first direction within the display panel, and form an image display area. Plural pixel rows having the plural pixels arranged in the first direction are juxtaposed along the second direction within the display panel. In the above source driver IC, the image signal generated on the basis of the digital display data DispDATA is outputted to an image signal line (source line DL in FIG. 8) arranged every this pixel series. Plural pixel lines having the plural pixels arranged in the second direction are juxtaposed along the first direction within the display panel. One of these pixel lines corresponds to the above "one line". A scanning signal line (gate line GL in FIG. 8) arranged every pixel line transmits the scanning signal to the switching element arranged in each pixel belonging to the pixel line corresponding to each scanning signal line. The transmission of the scanning signal using this scanning signal line is called a selection of the pixel line, or is also simply called a pixel selection, and is sequentially performed every pixel line. The image signal is supplied from one of the above plural image signal lines (corresponding to the respective plural pixel rows) to each pixel belonging to the pixel line selected in this way. In the display device operated by the active matrix system, an image is displayed by the connection of the operations of the scanning signal line and the image signal line mentioned above.

In the following explanation, a liquid crystal display device as representation of the display device will be illustrated to further concretely explain the display device of this embodiment. As shown in FIG. 8, the liquid crystal panel 1 arranged in the liquid crystal display device of this embodiment also has a structural feature of the display device of the so-called active matrix type having a thin film transistor TFT for selecting each pixel in each pixel. The liquid crystal panel 1 is constructed by nipping and supporting a liquid crystal between two substrates. Many gate lines GL (G-1, G-2, - - - , Gend, Gend+1) extended in the first direction and juxtaposed in the second direction transverse to the first direction, and many source lines DL (DiR, DiG, DiB, Di+1R, Di+1G, Di+1B, - - - ) extended in the above second direction and juxtaposed in the above first direction are arranged on the inner face of one of the two substrates. A unit pixel electrode having the thin film transistor TFT and selected by this thin film transistor is arranged as an active element in a crossing portion of this gate line GL and the source line DL. Reference character Cadd designates a load capacitance arranged in each unit pixel.

Many fluorescent materials arranged with respect to the above many unit pixels, and counter electrodes for forming an electric field between the counter electrodes and the above selected pixel electrodes with respect to the above many pixel electrodes are formed on the inner face of the other of the two substrates. The above two substrates are stuck to each other at a predetermined interval through the liquid crystal. The above unit pixel means each of three pixels of R, G, B constituting one color pixel. In the case of monochrome display, the unit pixel becomes one pixel.

A gate driver section 2 for supplying the scanning signal (gate signal) to the above many gate lines, and a source driver section 3 for supplying the image signal ("RGB-DATA") to the above many source lines (data lines) are arranged around the liquid crystal panel 1. Further, an interface circuit I/F mounting the display control circuit 4 for generating and controlling the scanning signal supplied to the gate line on the basis of the display signal inputted from an external signal source HOST, and the digital display data and the dot clock supplied to at least the above source line, and also mounting the power source circuit 5 is also arranged.

Figure 9:
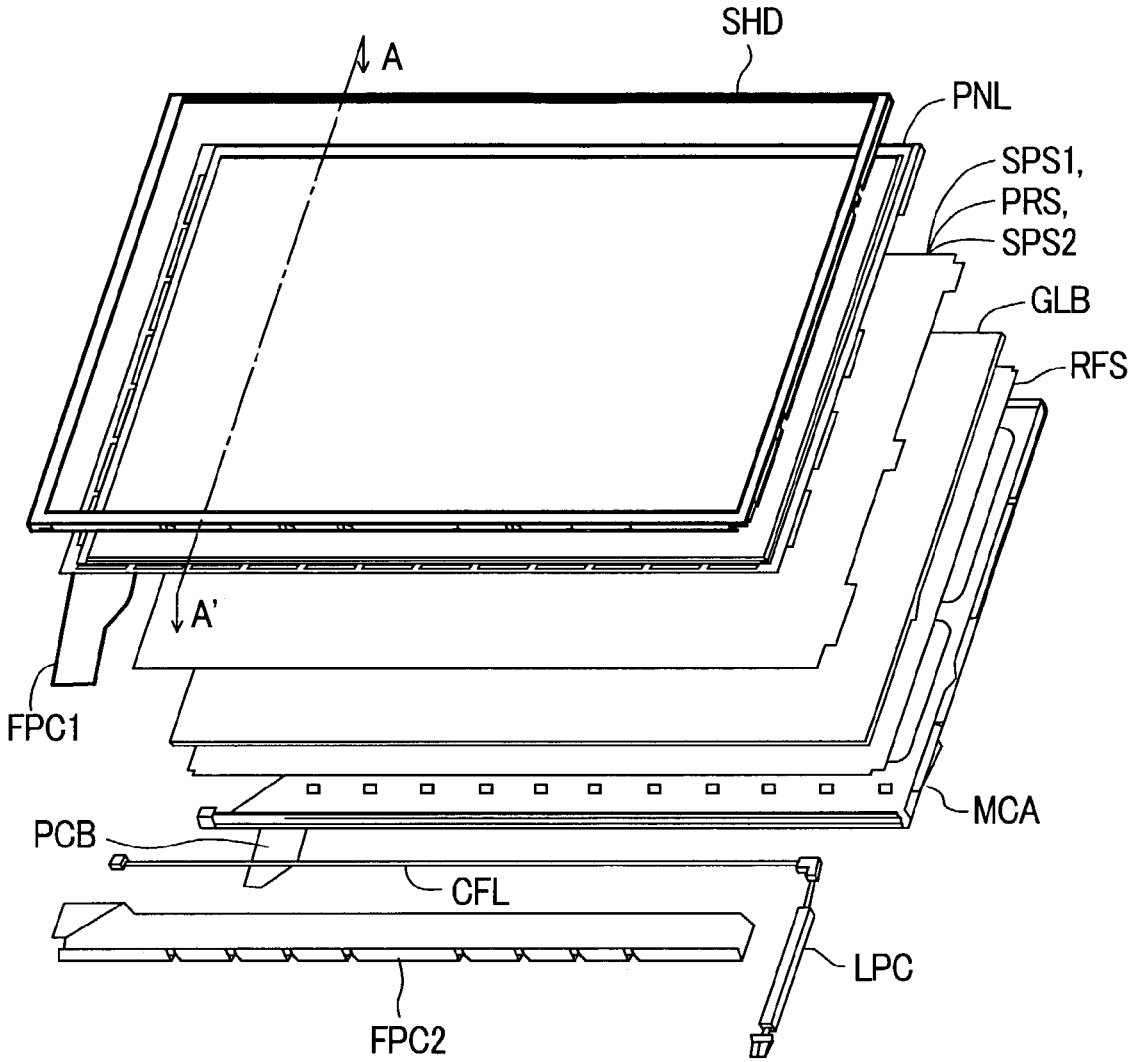
FIG. 9 is an exploded perspective view for explaining one example of the entire construction of the liquid crystal display device of one embodiment of the present invention.
Figure 10:
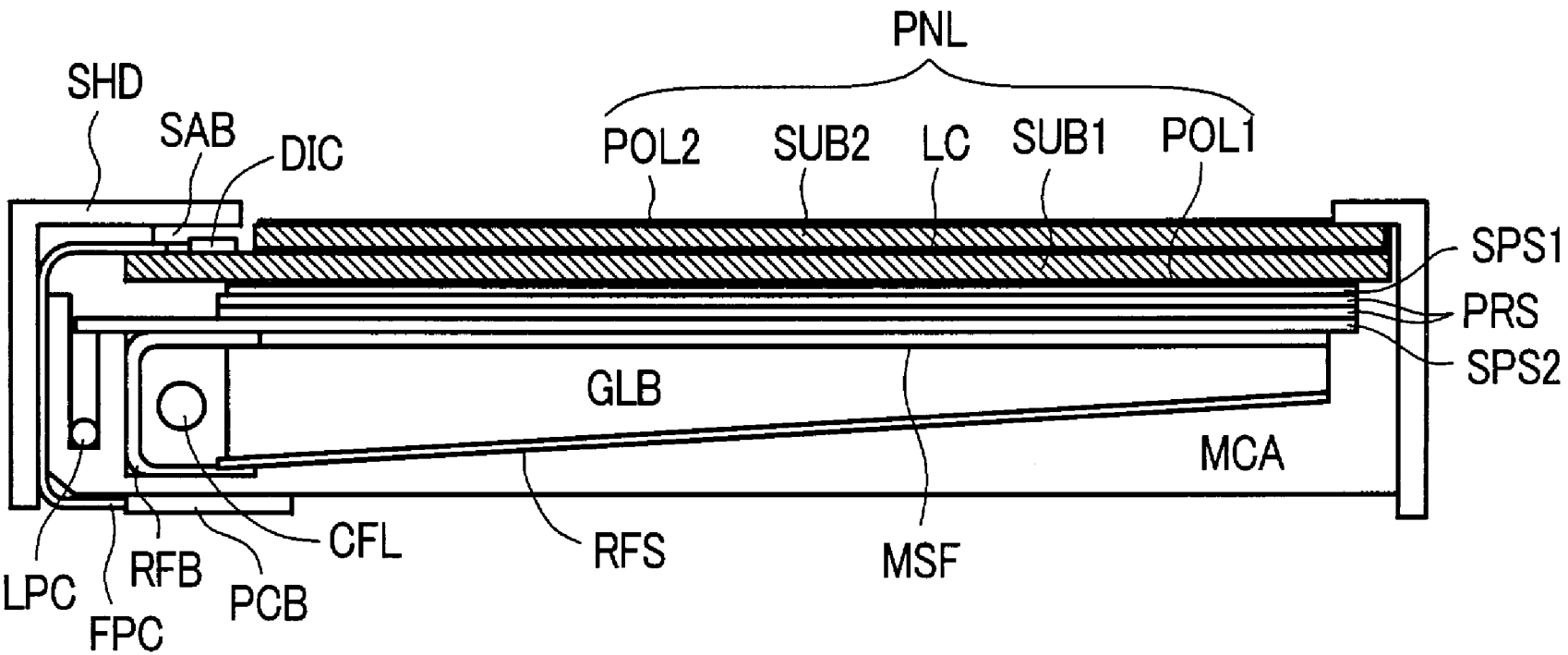
FIG. 10 is a sectional view along an A–A' line of FIG. 9.

FIG. 9 is a developed perspective view for explaining one example of the entire construction of the liquid crystal display device of one embodiment of the present invention. FIG. 10 is a sectional view along an A–A' line of FIG. 9, and shows a section in an integrating state of each constructional member of FIG. 9. In FIGS. 9 and 10, reference character PNL designates a liquid crystal display panel having the gate driver section 2 and the source driver section 3 in the liquid crystal panel 1 shown in FIG. 8. This liquid crystal display device has a so-called side edge backlight constructed by a light guide plate GLB and a cold cathode fluorescent lamp CFL on the rear face of the liquid crystal display panel PNL. A first diffusion sheet SPS1, a prism sheet PRS and a second diffusion sheet SPS2 for approximately uniformly irradiating light emitted from the backlight onto the face of the liquid crystal display panel PNL are laminated between this backlight and the liquid crystal display panel PNL.

Reference character PCB designates a printed board mounting the interface circuit I/F thereto. Reference characters FPC1 and FPC2 designate flexible printed boards for supplying data, a clock and power from the printed board PCB to the gate driver section 2 and the source driver section 3. Reference character RFS designates a reflection plate arranged on the rear face of the light guide plate GLB, and reference character LPC designates an electricity supply cable to the cold cathode fluorescent lamp CFL.

The laminating layer body of the liquid crystal display panel PNL and the backlight is gripped, supported and fixed by a shield case (upper side case) SHD and a mold case (lower side case) MCA, and is integrated as the liquid crystal display device.

As shown in FIG. 10, the liquid crystal display panel PNL is constructed by nipping and supporting the liquid crystal LC between the two substrates (first substrate SUB1 and second substrate SUB2), and polarizer plates POL2, POL1 are respectively stuck to the front and rear faces of the liquid crystal display panel PNL. Two adjacent sides of the first substrate SUB1 are projected from the second substrate SUB2, and a driver IC is mounted to this projection portion. Reference character DIC in FIG. 10 corresponds to the source driver IC explained in the above FIG. 1. The gate driver IC is also mounted to the side adjacent to the mounting side of the source driver IC in a similar mode although this gate driver IC is unillustrated. The contact of these driver ICs and the shield case SHD is prevented by a spacer SAB interposed between the first substrate SUB1 and the shield case SHD.

Figure 11:
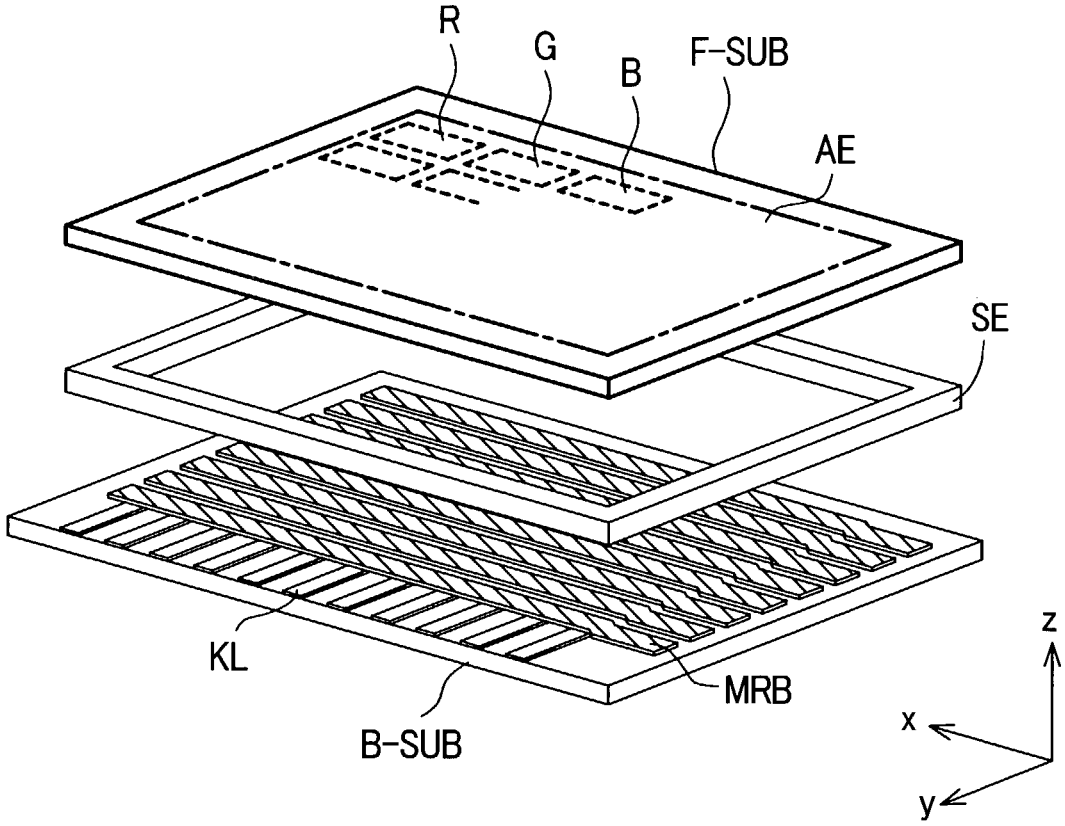
FIG. 11 is an exploded perspective view for explaining the schematic construction of an organic EL display device as the display device of another form applying the present invention thereto.

FIG. 11 is a developed perspective view for explaining the schematic construction of an organic EL display device as the display device of another form applying the present invention thereto. This organic EL display device has many cathode wirings KL extended in the y-direction and juxtaposed in the x-direction on the inner face of a lower side substrate B-SUB, and many control electrodes MRB insulated and arranged through predetermined gaps with respect to these cathode wirings KL. This control electrode MRB is constructed by many ribbon-shaped metallic thin plates extended in the x-direction and juxtaposed in the y-direction, and has an electron passing hole every unit pixel constructed by an electron source of a carbon nanotube, etc. arranged in the cathode wiring KL.

In contrast to this, the fluorescent materials R, G, B are arranged on the inner face of an upper side substrate F-SUB every unit pixel, and an anode AE is formed by covering these fluorescent materials. There is also a structure in which a light interrupting layer (black matrix) is arranged around the fluorescent materials R, G, B. This upper side substrate F-SUB and the above lower side substrate B-SUB are stuck to each other through an outer frame SF surrounding a display area, and the interior is exhausted in a vacuum. The unit pixel is formed by the cathode wiring KL, the control electrode MRB and the crossing portion, and a two-dimensional screen image is displayed by emitting electrons taken out of each unit pixel to the corresponding fluorescent material.

The present invention is not limited to the liquid crystal display device of the above embodiments, but can be similarly applied to another display device similarly operated, e.g., an organic EL display device and a plasma display device. Further, if plural sets of the circuits shown in FIGS. 1 to 3 and circuits having functions equivalent to those of these circuits are arranged in one display device, the transmission speed of image information from the display control circuit 4 to the display panel is improved. Further, in the display device for displaying a color image, each of the circuits of the plural sets may be also used in the image information transmission every display color (e.g., the three primary colors of RGB).

As explained above, in accordance with the present invention, a shift in the acquirement (latch) timing of the display data of a driver caused by a so-called skew caused between the display data and the clock during the propagation of a signal transmission path is automatically adjusted at the starting time of the normal display operation. Accordingly, the screen display of high quality having no flicker can be also obtained in the case of a large-sized screen.

What is claimed is:

1. A driving method for a display device having a display panel in which pixel lines each of which includes a plurality of pixels arranged in a first direction are juxtaposed in a second direction transverse to the first direction and at least one source driver supplying an image signal to each pixel belonging to one of the pixel lines being selected are arranged, and a display control circuit supplying parallel data and a clock supplied to the source driver, comprising:

a first step for generating dummy data as the parallel data having waveform varying with respect to each of the plurality of pixels contained in one of the pixel lines and for making the source driver acquire the dummy data; and a second step for converting the dummy data acquired in the source driver to serial data, sending the serial data to the display control circuit, converting the serial data to reference data in a parallel form in the display control circuit, and comparing the reference data with the dummy data, wherein the delay time of the clock to the parallel data is adjusted to be extended in the second step if waveform variation of the reference data is different from that of the dummy data.

2. A driving method for a display device according to claim 1, wherein the dummy data are generated again in the second step to be compared with the reference data in the second step.

3. A driving method for a display device according to claim 1, wherein the dummy data are acquired by the source driver in response to the clock.

4. A driving method for a display device according to claim 3, further comprising:

a third step for generating the dummy data again and for making the source driver acquire the dummy data in response to the clock having the delay time adjusted in the second step; and a fourth step for converting the dummy data acquired in the source driver in the third step to serial data, sending the serial data to the display control circuit, converting the serial data to reference data in a parallel form in the display control circuit, and comparing the reference data with the dummy data generated in the fourth step.

5. A driving method for a display device according to claim 4, wherein the delay time of the clock to the parallel data is adjusted to be extended in the fourth step if waveform variation of the reference data is different from that of the dummy data in the fourth step.

6. A driving method for a display device according to claim 5, wherein the third step and the fourth step are repeated if the waveform variation of the reference data is different from that of the dummy data in the fourth step, and the dummy data acquisition performed by the source driver in the third step is based on the clock having the delay time adjusted in the other fourth step prior to the third step.

7. A driving method for a display device according to claim 1, wherein the first step is started by powering the display device.

8. A driving method for a display device according to claim 1, wherein the dummy data are generated irrespective of image information inputted to the display device.

* * * * *